US010643591B2

(12) United States Patent
Hoshino

(10) Patent No.: US 10,643,591 B2
(45) Date of Patent: May 5, 2020

(54) KEYBOARD INSTRUMENT

(71) Applicant: CASIO COMPUTER CO., LTD., Shibuya-ku, Tokyo (JP)

(72) Inventor: Akihisa Hoshino, Fussa (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 0 days.

(21) Appl. No.: 15/981,751

(22) Filed: May 16, 2018

(65) Prior Publication Data

US 2018/0350335 A1 Dec. 6, 2018

(30) Foreign Application Priority Data

Jun. 1, 2017 (JP) ..... 2017-109554

(51) Int. Cl.

| | |
|---|---|
| ***G10G 5/00*** | (2006.01) |
| ***G10H 1/34*** | (2006.01) |
| ***G10H 1/32*** | (2006.01) |
| ***G10C 3/02*** | (2006.01) |

(52) U.S. Cl.

CPC ..... *G10G 5/005* (2013.01); *G10C 3/02* (2013.01); *G10H 1/32* (2013.01); *G10H 1/344* (2013.01)

(58) Field of Classification Search

CPC . G10G 5/005; G10C 3/02; G10H 1/32; G10H 1/344

See application file for complete search history.

(56) References Cited

U.S. PATENT DOCUMENTS 5,465,644 A * 11/1995 Shimoda ..... G10C 3/02 84/177
6,180,859 B1 1/2001 Konishi
6,660,917 B2 12/2003 Goto et al.
7,060,890 B2 6/2006 Sato et al.

(Continued)

FOREIGN PATENT DOCUMENTS

JP 49026271 Y1 7/1974
JP 58118495 U 8/1983

(Continued)

OTHER PUBLICATIONS

Related U.S. Appl. No. 15/976,486; First Named Inventor: Akihisa Hoshino; Title: "Keyboard Instrument"; Filed: May 10, 2018.

(Continued)

*Primary Examiner* — Kimberly R Lockett
(74) *Attorney, Agent, or Firm* — Holtz, Holtz & Volek PC

(57) ABSTRACT

A keyboard instrument includes an instrument main body having a keyboard unit, a stand which supports the instrument main body, main body fixing sections which are first fixing members for fixing the instrument main body to the stand, side plate fixing sections which are second fixing members for fixing the stand to the instrument main body, and front side screw members each of which is a third fixing member for fixing one of the main body fixing sections to one of the side plate fixing sections with them corresponding to each other in the front-rear direction of the instrument main body. Accordingly, in a state where the stand is supporting the instrument main body, each main body fixing section and each side plate fixing section can be fixed to each other by one of the front side screw members being screwed thereinto from in front of the instrument main body.

11 Claims, 15 Drawing Sheets

(56) References Cited

U.S. PATENT DOCUMENTS

| | | | |
|---|---|---|---|
| 7,427,723 | B2 | 9/2008 | Watanabe |
| 7,488,884 | B2 | 2/2009 | Ohno et al. |
| 7,692,089 | B2 | 4/2010 | Nishida |
| 8,420,917 | B1 | 4/2013 | Yokozeki et al. |
| 2001/0052280 | A1 | 12/2001 | Konishi et al. |
| 2003/0051594 | A1 | 3/2003 | Ishihara et al. |
| 2004/0173086 | A1 | 9/2004 | Sato et al. |
| 2004/0182223 | A1 | 9/2004 | Kuwahara et al. |
| 2004/0250671 | A1 | 12/2004 | Ohno et al. |
| 2006/0137508 | A1 | 6/2006 | Sakurai |
| 2006/0137509 | A1 | 6/2006 | Haba et al. |
| 2007/0018960 | A1 | 1/2007 | Nishida |
| 2007/0295192 | A1 | 12/2007 | Watanabe |
| 2008/0072747 | A1 | 3/2008 | Nishida |
| 2008/0295668 | A1 | 12/2008 | Konishi |
| 2010/0147132 | A1 | 6/2010 | Shinjo et al. |
| 2010/0192756 | A1 | 8/2010 | Kato et al. |
| 2012/0006185 | A1 | 1/2012 | Mishima et al. |
| 2013/0008296 | A1 | 1/2013 | Tsuchimoto et al. |
| 2015/0179151 | A1 | 6/2015 | Nagatsuma |
| 2016/0105743 | A1 | 4/2016 | Yamazaki et al. |
| 2017/0061944 | A1 | 3/2017 | Muramatsu |
| 2017/0206878 | A1 | 7/2017 | Hoshino |
| 2018/0182363 | A1 | 6/2018 | Hoshino |

FOREIGN PATENT DOCUMENTS

| | | | |
|---|---|---|---|
| JP | 58118496 | U | 8/1983 |
| JP | 60161400 | U | 10/1985 |
| JP | 05297865 | A | 11/1993 |
| JP | H10282950 | A | 10/1998 |
| JP | 2009210803 | A | 9/2009 |
| JP | 2013047832 | A | 3/2013 |
| RU | 2347281 | C1 | 2/2009 |

OTHER PUBLICATIONS

Russian Search Report dated Sep. 19, 2018 (and English translation thereof) issued in counterpart Russian Application No. 2018120112.
Japanese Office Action dated Mar. 5, 2019 (and English translation thereof) issued in Japanese Application No. 2018-036273.
Notice of Allowance dated Nov. 19, 2018 issued in U.S. Appl. No. 15/976,486.

* cited by examiner

KEYBOARD INSTRUMENT

CROSS-REFERENCE TO RELATED APPLICATION

This application is based upon and claims the benefit of priority from the prior Japanese Patent Application No. 2017-109554, filed Jun. 1, 2017, the entire contents of which are incorporated herein by reference.

BACKGROUND OF THE INVENTION

1. Field of the Invention

The present invention relates to a keyboard instrument such as an electronic keyboard instrument.

2. Description of the Related Art

For example, an electronic keyboard instrument is known which includes an instrument main body mounted with a keyboard unit and a stand which supports the instrument main body, as described in Japanese Patent Application Laid-Open (Kokai) Publication No. 2013-047832.

This type of stand for an electronic keyboard instrument includes a pair of side plates opposing each other and a rear plate attached to the rear side of the pair of side plates. In upper portions of the opposing surfaces of the pair of side plates, guide concave sections into which the sides of the instrument main body are respectively fitted are provided extending from the front ends of the side plates toward the rear ends. Also, on front and rear portions of each side plate located under each guide concave section in the pair of side plates, fixing brackets bent in an L-shape are provided.

In the case of this electronic keyboard instrument, when the instrument main body is to be attached to the stand, the stand is assembled in advance, and the sides of the instrument main body are inserted and fitted into the guide concave sections in the opposing surfaces of the pair of side plates with the rear side of the instrument main body as a leading end. Then, in this state, screws are screwed into the bottom of the instrument main body via attachment holes provided in the L-shaped fixing brackets, and whereby the instrument main body is fixed on the stand.

However, this electronic keyboard instrument has a problem in that, when fixing the bottom of the instrument main body on the fixing brackets on the side plates by the screws with the sides of the instrument main body being fitted into the guide concave sections in the opposing surfaces of the pair of side plates of the stand, the assembling person needs to crawl under the instrument main body so as to fix by the screws, which degrades the assembling workability.

An object of the present invention is to provide a musical instrument whose main body can be unfailingly and favorably mounted on a stand so that the assembling workability is improved.

SUMMARY OF THE INVENTION

In accordance with one aspect of the present invention, there is provided a keyboard instrument comprising: an instrument main body which has a first fixing member; a stand which supports the instrument main body; a guide rail which includes a second fixing member and guides the instrument main body so that the instrument main body is fitted into the stand; and a third fixing member which fixes the first fixing member and the second fixing member, wherein the first fixing member and the second fixing member are positioned in a front-rear direction of the instrument main body.

In accordance with another aspect of the present invention, there is provided a keyboard instrument comprising: an instrument main body which has a keyboard; a stand which supports the instrument main body; a first fixing member which has a first hole and fixes the stand to the instrument main body; a second fixing member which has a second hole and fixes the instrument main body to the stand; and a third fixing member which fixes the first fixing member to the second fixing member by being inserted through the first hole and the second hole which are positioned in a front-rear direction of the instrument main body, wherein the first fixing member and the second fixing member are in contact with each other or are positioned close to each other, wherein a first angle formed in front of opposing surfaces of the first fixing member and the second fixing member with respect to an inner surface of the stand is larger than a second angle formed behind the opposing surfaces with respect to the inner surface of the stand, and wherein the third fixing member is diagonally inserted through the first hole and the second hole from in front of the instrument main body toward a rear sideward direction.

The above and further objects and novel features of the present invention will more fully appear from the following detailed description when the same is read in conjunction with the accompanying drawings. It is to be expressly understood, however, that the drawings are for the purpose of illustration only and are not intended as a definition of the limits of the invention.

BRIEF DESCRIPTION OF THE DRAWINGS

The present invention can be more clearly understood by the detailed description below being considered together with the following drawings.

FIG. 4A to FIG. 4*c* are diagrams showing the instrument main body of the keyboard instrument shown in FIG. 1, of which FIG. 4A is a front view thereof, FIG. 4B is a planar view thereof, and FIG. 4C is a left side view thereof;

FIG. 11A and FIG. 11B are diagrams showing the side plate of FIG. 8 when a plurality of members are attached thereto, of which FIG. 11A is an exploded perspective view of the side plate when a locking section of a rear side fixing member, a hook section of a position restriction member, a reinforcing plate of a side plate fixing section of a front side fixing member are attached thereto, and FIG. 11B is an exploded perspective view of the side plate when the side plate fixing section is assembled by a guide rail being attached to the side plate;

FIG. 12A and FIG. 12B are diagrams showing a main body fixing section of the front side fixing member on the instrument main body shown in FIG. 10, of which FIG. 12A is an enlarged perspective view of the main body fixing section in a disassembled state, and FIG. 12B is an enlarged perspective view of the main body fixing section in an assembled state;

FIG. 15A to FIG. 15C are diagrams showing main parts of the keyboard instrument shown in FIG. 14, of which FIG. 15A is an enlarged sectional view of one main part taken along line B-B. FIG. 15B is an enlarged sectional view of another main part taken along line C-C, and FIG. 15C is an enlarged sectional view of yet another main part taken along line D-D.

DETAILED DESCRIPTION OF THE PREFERRED EMBODIMENTS

An embodiment in which the present invention has been applied in a keyboard instrument will hereinafter be described with reference to FIG. 1 to FIG. 15.

Figure 1:
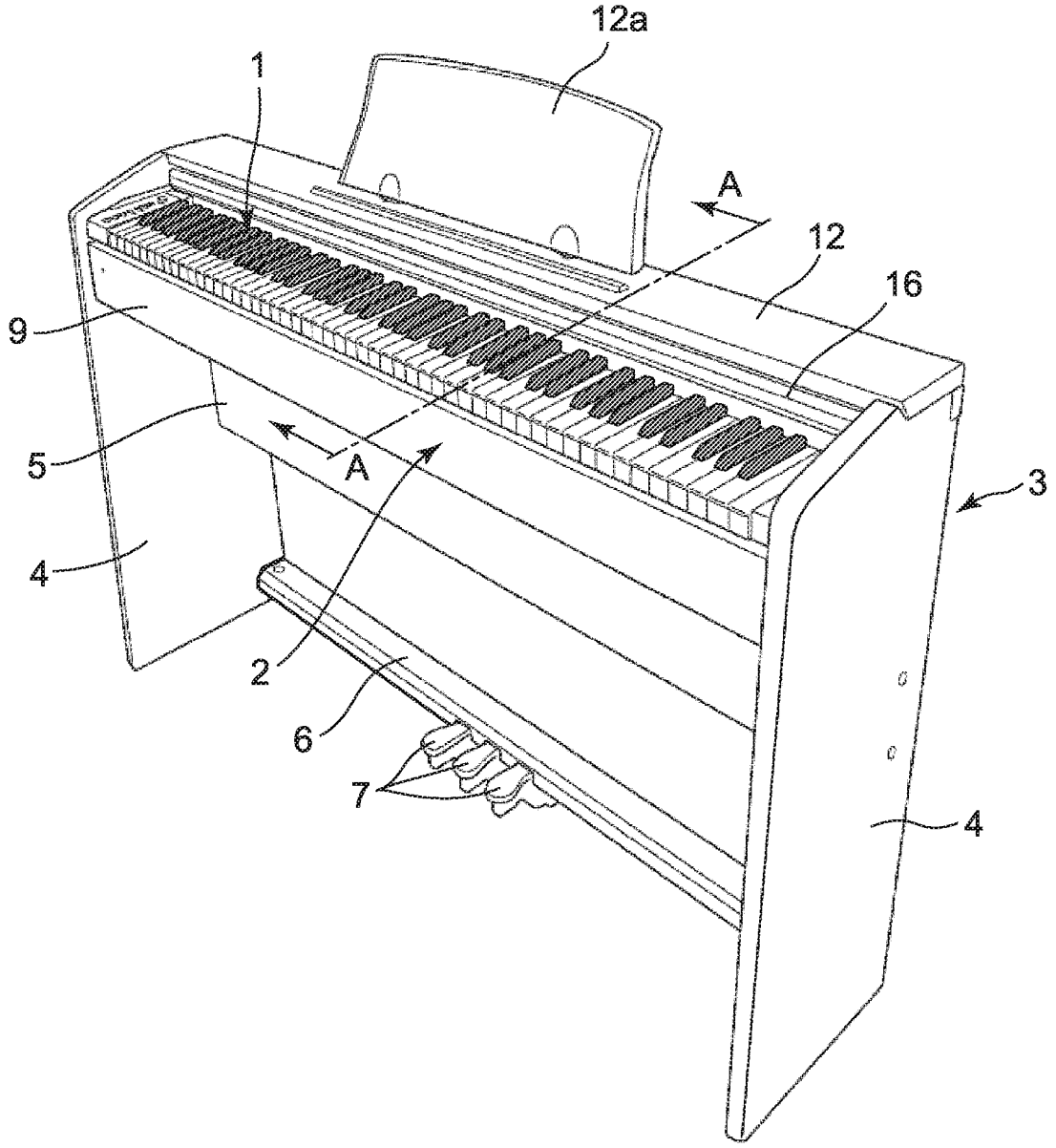
FIG. 1 is a perspective view of an embodiment in which the present invention has been applied in a keyboard instrument.
Figure 2:
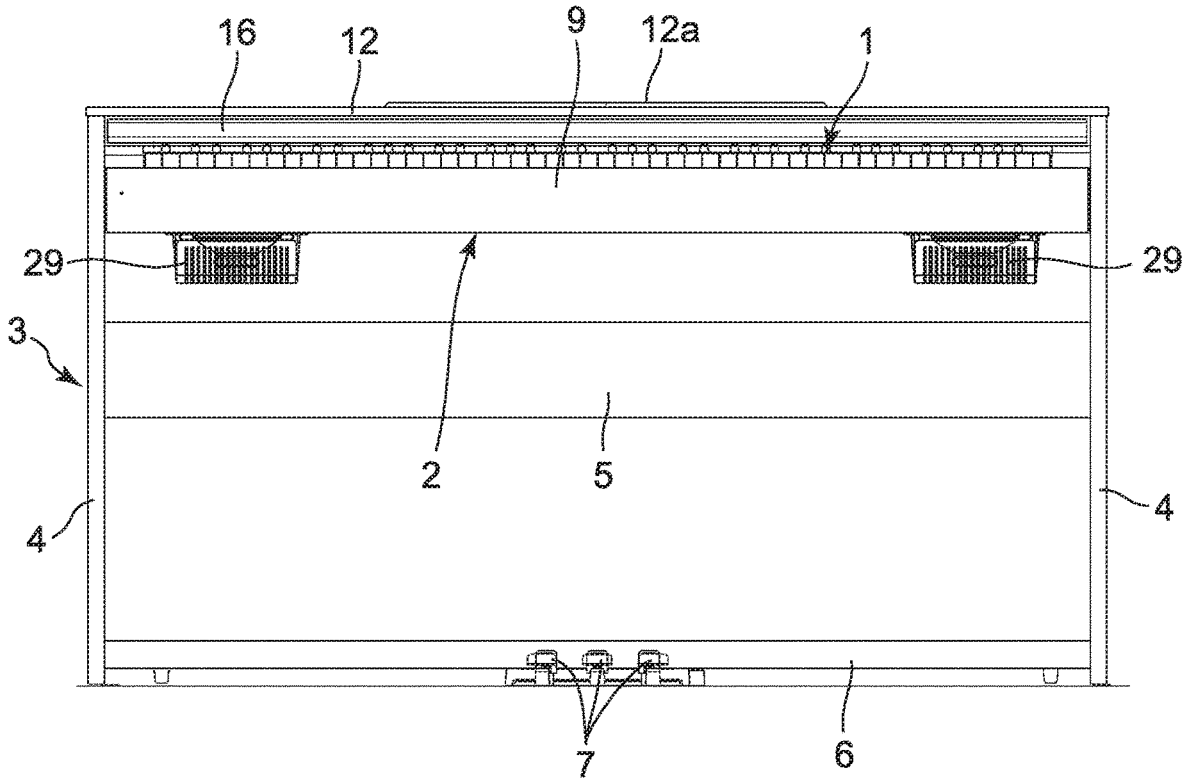
FIG. 2 is a front view of the keyboard instrument shown in FIG. 1.
Figure 3A:
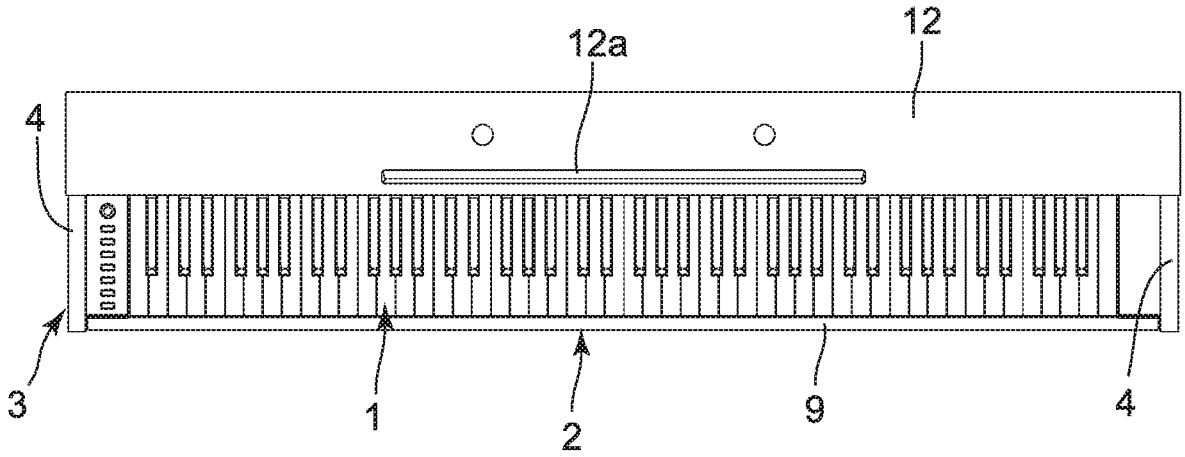
FIG. 3A is a planar view of the keyboard instrument shown in FIG. 2.
Figure 3B:
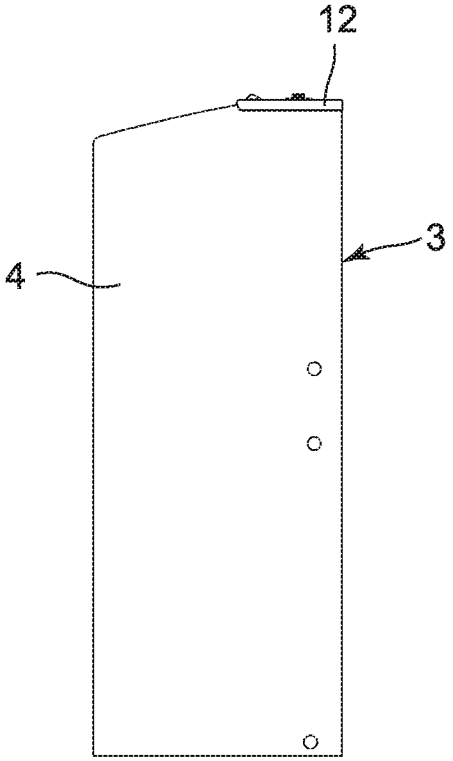
FIG. 3B is a right side view thereof.
Figure 4A:
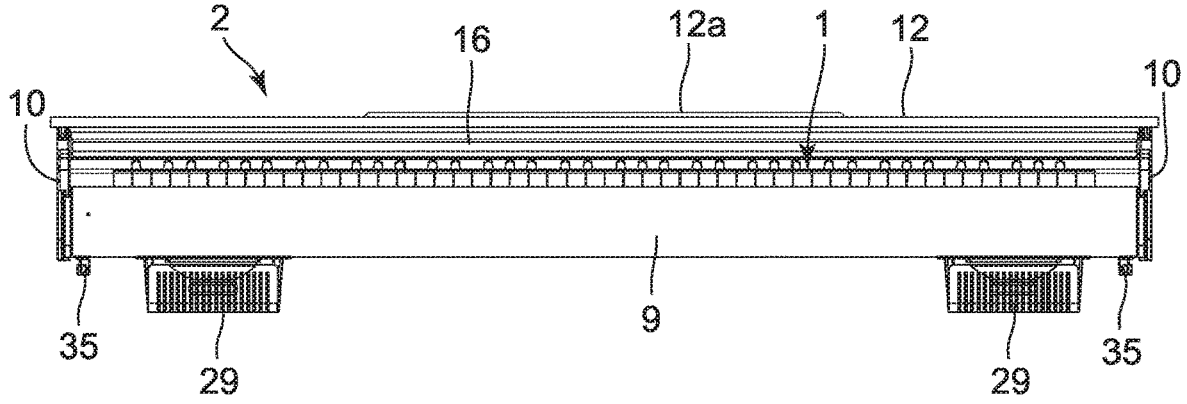
Figure 4B:
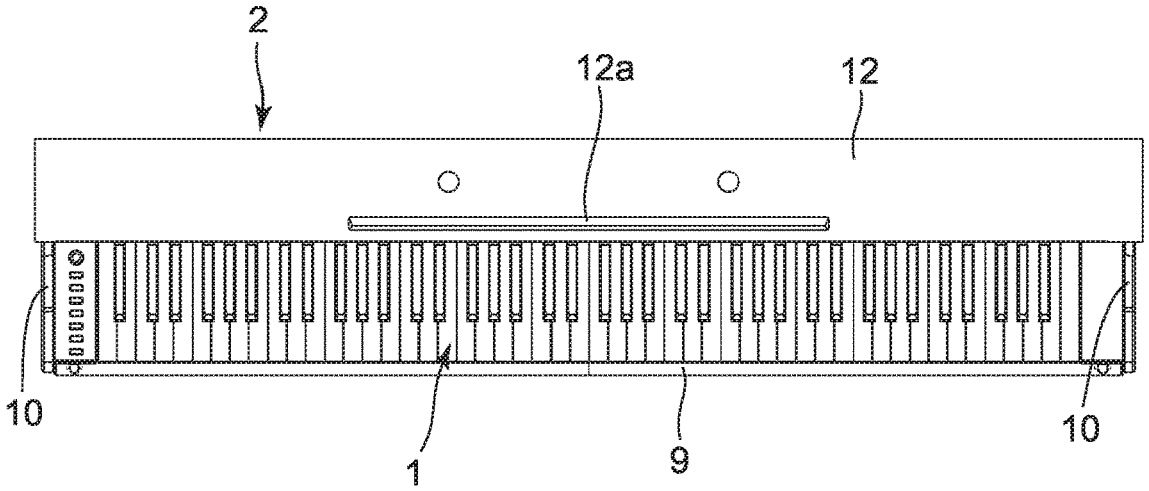
Figure 4C:
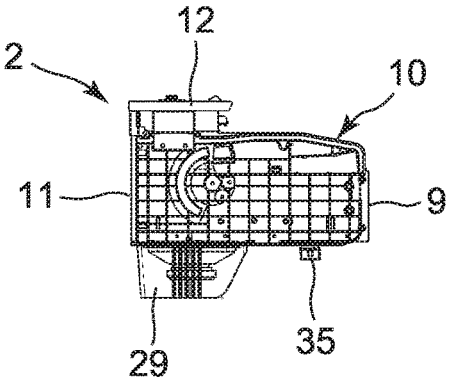

This keyboard instrument includes an instrument main body 2 mounted with a keyboard unit 1, and a stand 3 having a pair of side plates 4 which supports the sides of the instrument main body 2, as shown in FIG. 1 to FIG. 3.

The stand 3 includes the pair of side plates 4, a rear plate 5 arranged between rear end portions of the pair of side plates 4, and a pedal member 6 arranged between lower portions of the pair of side plates 4, as shown in FIG. 1 to FIG. 3. In this embodiment, the pedal member 6 has a plurality of foot pedals 7 provided in its middle portion in the longitudinal direction.

The instrument main body 2 is formed substantially in a horizontally elongated box shape, as shown in FIG. 1 to FIG. 6. More specifically, this instrument main body 2 includes a bottom plate 8 having a horizontally elongated band plate shape, a front plate 9 provided upright on the front end of the bottom plate 8, a pair of side wall sections 10 provided upright on the left and right ends of the bottom plate 8 in the longitudinal direction, a back plate 11 provided upright on the rear end of the bottom plate 8, and a top plate 12 provided on upper portions of the back plate 11 and the side wall sections 10, as shown in FIG. 1 to FIG. 6.

In this embodiment, the front plate 9 is provided such that its height is smaller than that of the back plate 11, as shown in FIG. 1 to FIG. 6. The top plate 12 is provided such that its length in the front-rear direction is smaller than that of the bottom plate 8. Also, this top plate 12 is provided such that its right and left ends in the longitudinal direction protrude from the pair of side wall sections 10 and arranged on the pair of side plates 4 of the stand 3. As a result, the instrument main body 2 is formed substantially in a horizontally elongated box shape whose portion in front of the top plate 12 is open upward.

In the instrument main body 2, the keyboard unit 1 is provided to be exposed in the anterosuperior direction of the instrument main body 2, as shown in FIG. 1 to FIG. 6. This keyboard unit 1 includes a keyboard chassis 13 arranged on the bottom plate 8 of the instrument main body 2, a plurality of keys 14 arranged on the keyboard chassis 13, and a plurality of hammer members 15 that are rotated in response to key depression operations on the plurality of keys 14 and apply action loads to the plurality of keys 14, as shown in FIG. 1 to FIG. 6.

Figure 5:
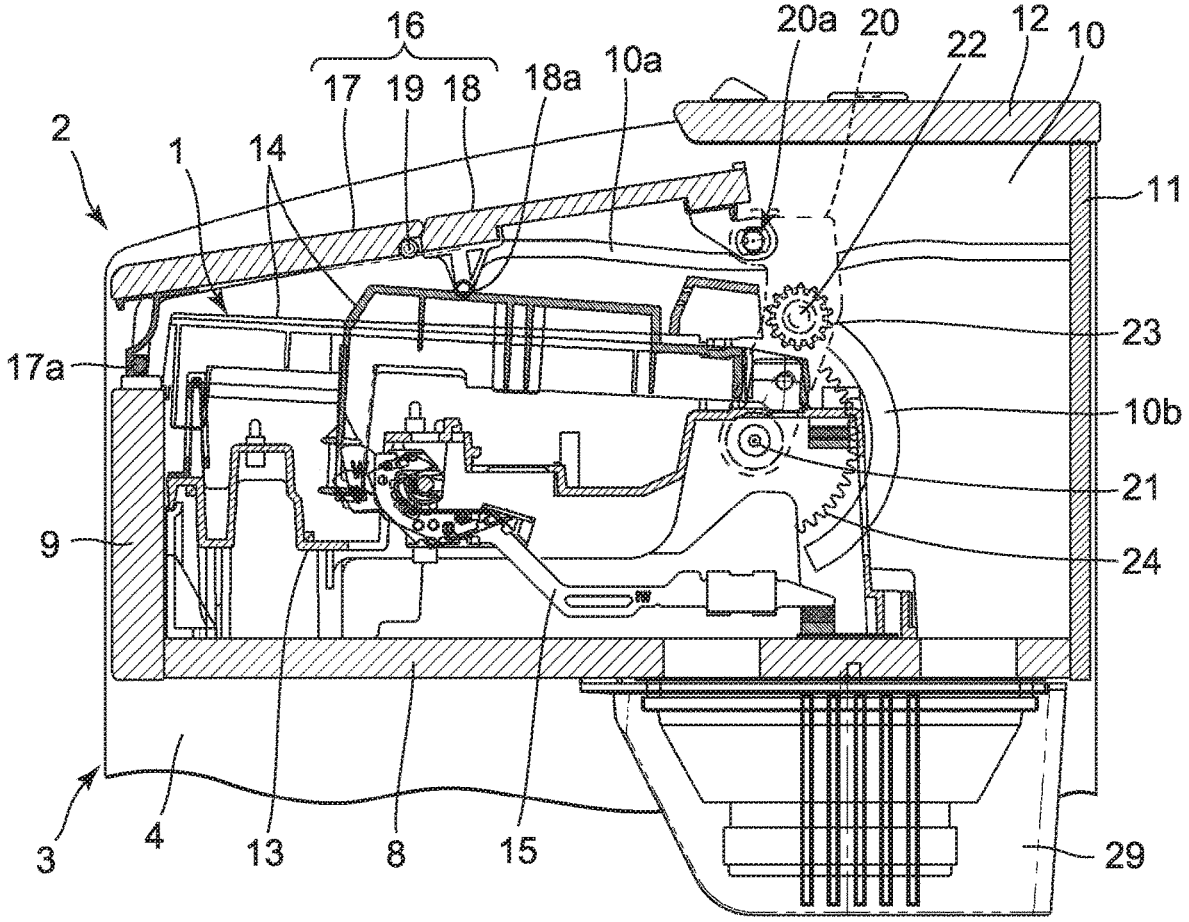
FIG. 5 is an enlarged cross-sectional view of the main portion of the keyboard instrument taken along line A-A in FIG. 1, in which a keyboard cover has been closed.
Figure 6:
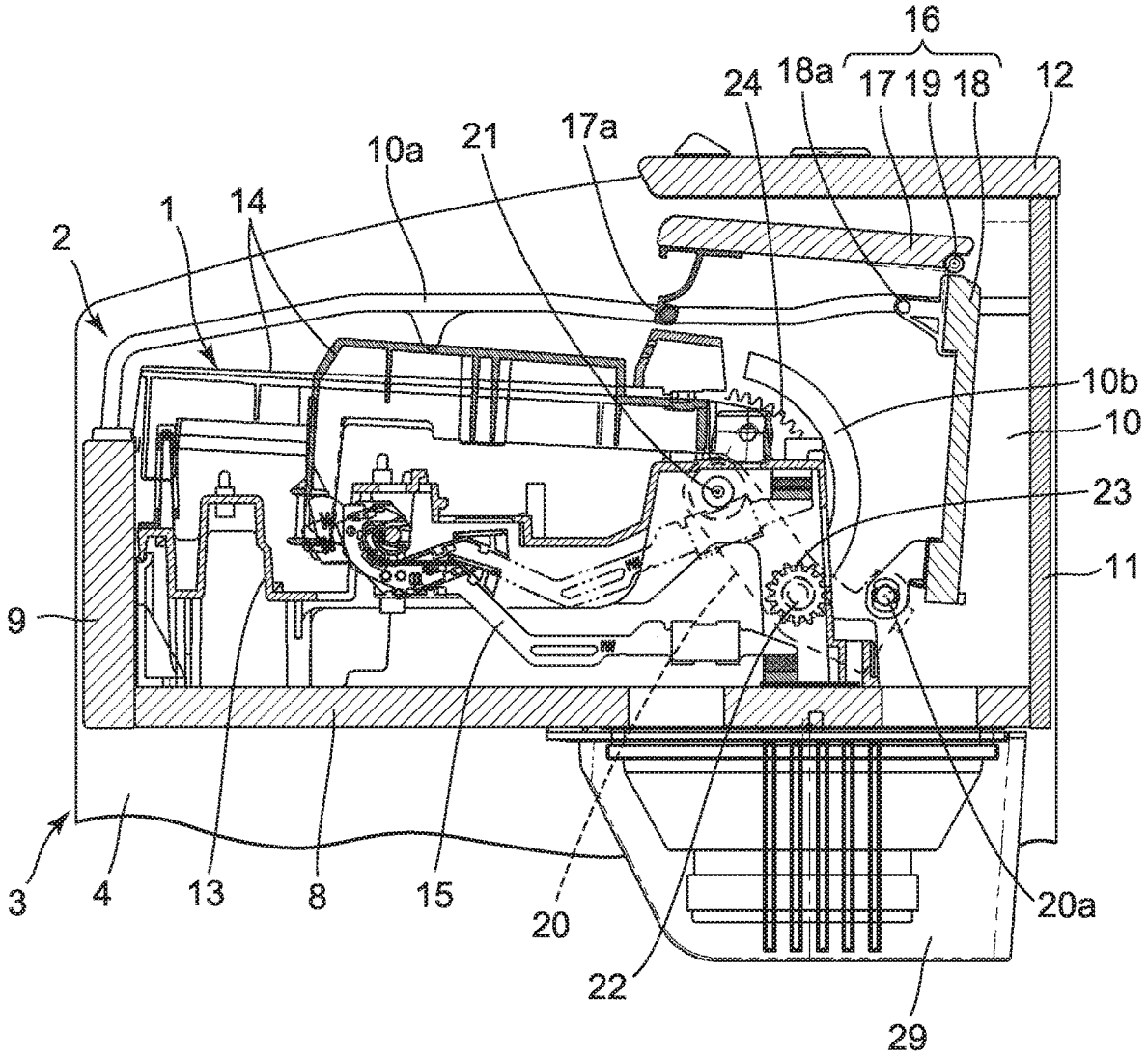
FIG. 6 is an enlarged cross-sectional view of the main portion of the keyboard instrument shown in FIG. 5, in which the keyboard cover has been opened.

Also, in the instrument main body 2, a keyboard cover 16 for openably and closably covering the keyboard unit 1 is provided, as shown in FIG. 5 and FIG. 6. This keyboard cover 16 includes a front cover 17 and a rear cover 18, and is foldable at hinges 19 coupling the rear end of the front cover 18 and the front end of the rear cover 19 together. In this embodiment, on the front end of the front cover 17, front guide shafts 17*a* are provided which are moved along first guide grooves 10*a* provided in the inner surfaces of the pair of side wall sections 10.

Also, on the front end of the rear cover 18, rear guide shafts 18*a* are provided which are also moved along the first guide grooves 10*a* provided in the pair of side wall sections 10, as shown in FIG. 5 and FIG. 6. To the rear end of this rear cover 18, one end of each support arm 20 is rotatably attached via a connection shaft 20*a*. The other end thereof is rotatably attached to a support shaft 21 provided on the inner surface of each side wall section 10. These support arms 20 are rotated around the support shafts 21 in the vertical direction.

In this embodiment, the support arms 20 have auxiliary guide shafts 22 that are moved along second guide grooves 10*b* provided in the inner surfaces of the side wall sections 10 and having arc-like shapes centering on the support shafts 21, as shown in FIG. 5 and FIG. 6. To these auxiliary guide shafts 22, pinions 23 are rotatably attached. These pinions 23 are rotated and moved while engaging with racks 24 having arc-like shapes centering on the support shafts 21.

As a result of this structure, when the front cover 17 and the rear cover 18 of the keyboard cover 16 are pulled toward the front side of instrument main body 2, the front guide shafts 17*a* of the front cover 17 and the rear guide shafts 18*a* of the rear cover 18 are moved along the first guide grooves 10*a* in the side wall sections 10, and accordingly the support arms 20 are rotated counterclockwise around the support shafts 21 so as to push the rear end of the rear cover 18 upward, as shown in FIG. 5 and FIG. 6. Consequently, the Keyboard cover 16 is arranged above the keyboard unit 1 and thereby covers it, as shown in FIG. 5.

Also, when the front cover 17 and the rear cover 18 of the keyboard cover 16 are pressed toward the rear side of instrument main body 2, the rear cover 18 is gradually downwardly moved with respect to the front cover 17 by bending by the hinges 19 while the front guide shafts 17*a* of the front cover 17 and the rear guide shafts 18*a* of the rear cover 18 are moved along the first guide grooves 10*a* in the side wall sections 10, and the support arms 20 are rotated clockwise around the support shafts 21 so as to pull the rear end of the rear cover 18 downward, as shown in FIG. 6.

Consequently, the rear cover 18 of the keyboard cover 16 bent by the hinges 19 hangs down in parallel with the back plate 11 at a position close to the back plate 11, and the front cover 17 is arranged under the top plate 12 with it being positioned substantially in parallel with the top plate 12, whereby the keyboard unit 1 is exposed frontward and upward, as shown in FIG. 6. Note that, on right and left side portions of the undersurface of the bottom plate 8 of the instrument main body 2, loudspeaker sections 29 are provided, as shown in FIG. 2 and FIG. 4 to FIG. 6. Also, on the top plate 12 of the instrument main body 2, a music stand 12*a* is provided.

The pair of side wall sections 10 of the instrument main body 2 is made of synthetic resin, as shown in FIG. 7, FIG. 9, FIG. 10 and FIG. 13. On the outer surface of each side wall section 10, a first fitting section 101 is provided. Each first fitting section 101 includes a first fitting convex section 102 provided on the outer upper side of the corresponding side wall section 10, a first fitting concave section 103 provided below the first fitting convex section 102 and having a height lower than that of the first fitting convex section 102, and a first guide section 104 provided between the first fitting convex section 102 and the first fitting concave section 103.

Figure 7:
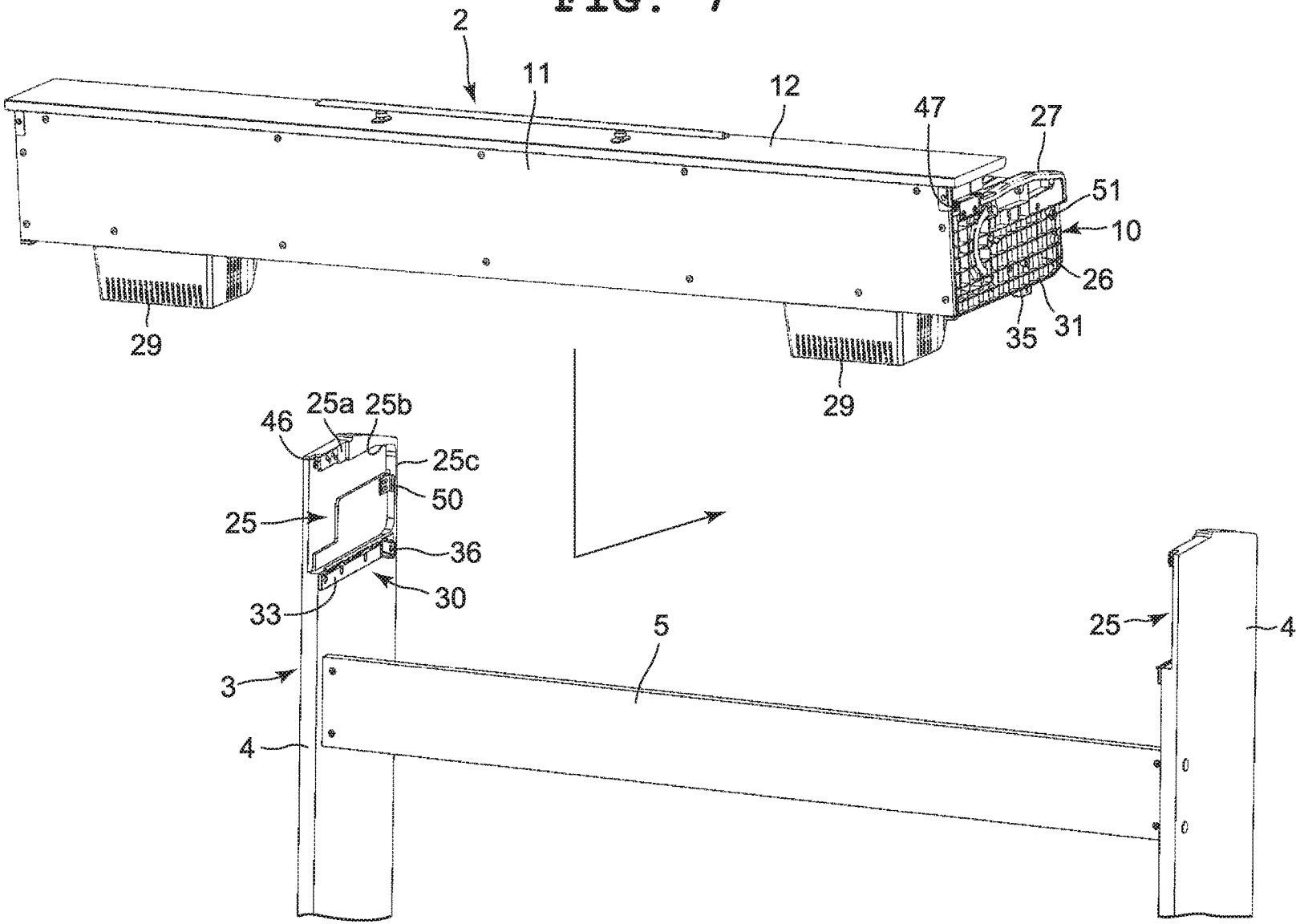
FIG. 7 is an exploded perspective view of the keyboard instrument of FIG. 1 when the instrument main body is attached to a stand from behind.
Figure 8:
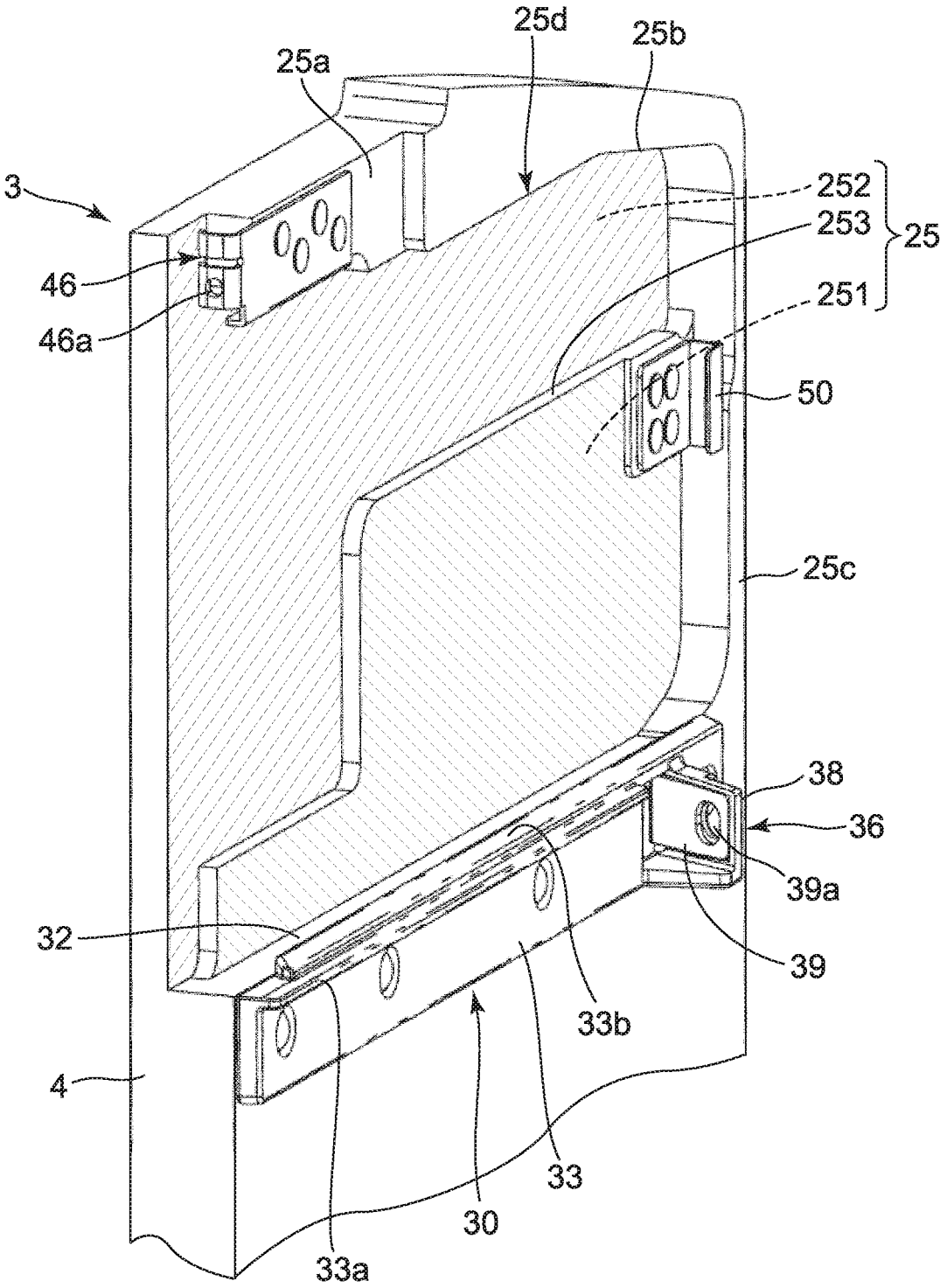
FIG. 8 is an enlarged perspective view of the main portion, in which a fitting recess in a side plate on the left side of the stand for the keyboard instrument of FIG. 7 is shown.
Figure 13:
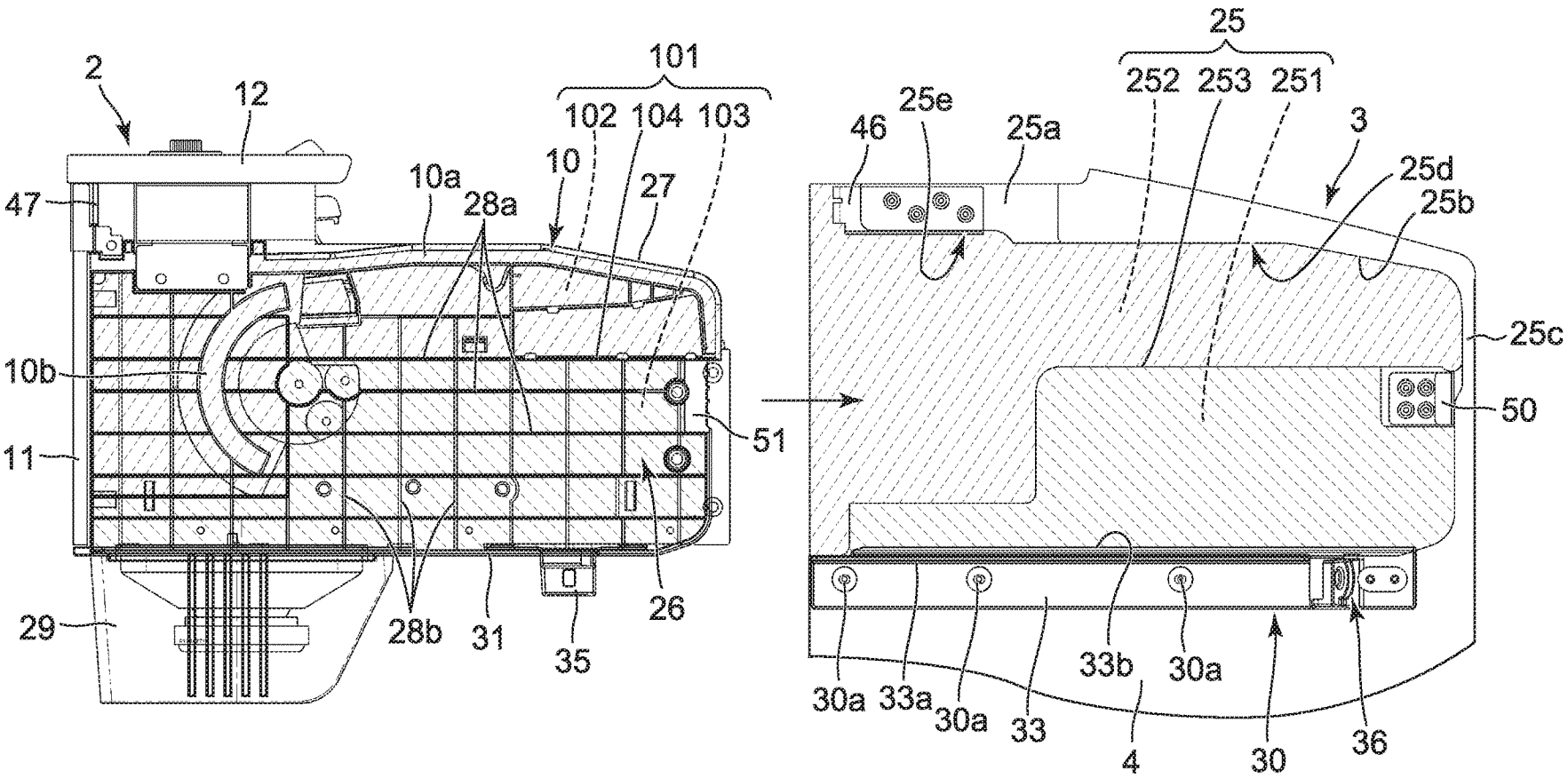
FIG. 13 is an enlarged view of the main portion, which shows the insertion of the side wall section of the instrument main body into the fitting recess of the stand shown in FIG. 7.

On the other hand, in the opposing surfaces of the pair of side plates 4 of the stand 3, second fitting sections 25 are provided which have concave shapes and into which the first fitting sections 101 on the pair of side wall sections 10 of the instrument main body 2 are slidably fitted, as shown in FIG. 7, FIG. 8 and FIG. 13. Each second fitting section 25 having a concave shape includes a second fitting convex section 251 corresponding to the first fitting concave section 103 of the corresponding side wall section 10, a second fitting concave section 252 corresponding to the first fitting convex section 102 of the corresponding side wall section 10, and a second guide section 253 provided between the second fitting convex section 251 and the second fitting concave section 252 so as to correspond to the first guide section 104 of the corresponding side wall section 10.

In this embodiment, each second fitting section 25 having a concave shape in the side plates 4 is provided extending from the rear end of the corresponding side plate 4 toward the front side, as shown in FIG. 7 and FIG. 8. More specifically, the front end 25*c* of this second fitting section 25 on the front side of the side plate 4 is walled and the rear end thereof on the rear side of the side plate 4 is open. In this embodiment, each second fitting section 25 is formed such that its depth in the thickness direction of the corresponding side plate 4 is substantially equal to the thickness of the corresponding side wall section 10 of the instrument main body 2.

That is, the second fitting convex section 251 of the second fitting section 25 is shallowly formed such that its depth in the thickness direction of the side plate 4 is substantially half the thickness of the side plate 4, as shown in FIG. 7 and FIG. 8. As a result, the second fitting convex section 251 and the first fitting concave section 103 of the side wall section 10 fit together. Also, the second fitting concave section 252 of the second fitting section 25 is formed such that its depth in the thickness direction of the side plate 4 is larger than the depth of the second fitting convex section 251. As a result, the second fitting concave section 252 and the first fitting convex section 102 of the side wall section 10 fit together.

Also, each second fitting section 25 is formed such that its inner vertical length (entrance) on the rear side is larger (wider) than its inner vertical length on the front side, as shown in FIG. 8. That is, the second fitting concave section 252 of each second fitting section 25 is formed such that its vertical length (entrance) on the rear side is larger (wider) than its vertical length on the front side.

Moreover, each second fitting section 25 includes the second guide section 253 provided between the second fitting convex section 251 and the second fitting concave section 252, as shown in FIG. 8. This second guide section 253 is provided to have a step shape as a whole, of which the front portion is located in a substantially middle area in the vertical direction in the second fitting section 25, the rear portion is located lower than the front portion, and the middle portion in the horizontal direction in the second fitting section 25 is provided with a stepped portion.

Figure 14:
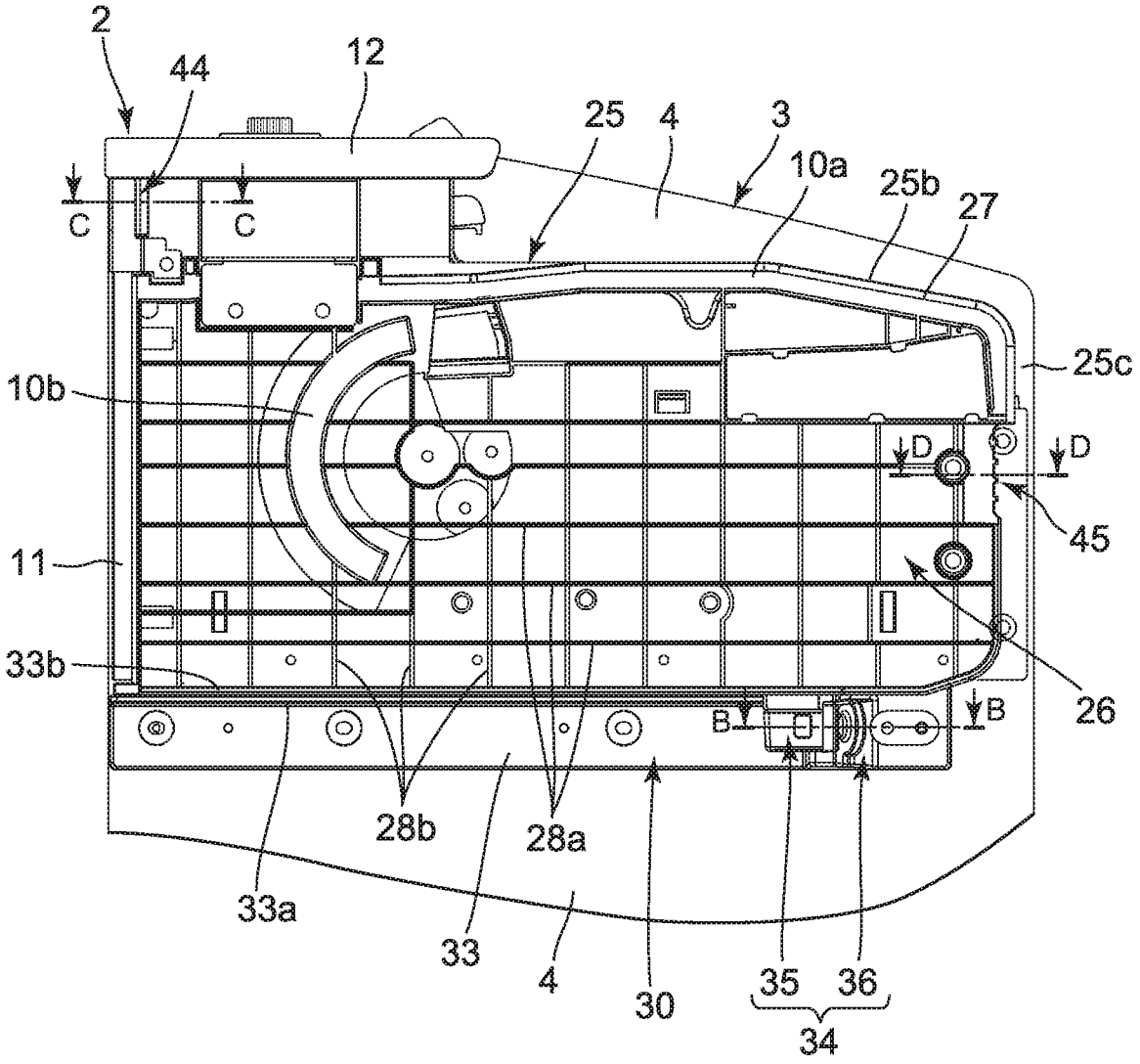
FIG. 14 is an enlarged view of the main portion of the keyboard instrument shown in FIG. 13, in which the side wall section of the instrument main body has been fitted into the fitting recess of the stand.

The upper end of the second fitting concave section 252 of each second fitting section 25 includes a first upper end section 25*d* which comes in contact with the corresponding first fitting section 101 when this first fitting section 101 of the instrument main body 2 and the second fitting section 25 are fitted together, and a second upper end section 25*e* which is arranged closer to the rear side than the first upper end section 25*d* and does not come in contact with the first fitting section 101, as shown in FIG. 8, FIG. 13 and FIG. 14.

On an upper rear portion of the second fitting section 25 of each side plate 4, a bracket attaching section 25*a* slightly thinner than the corresponding side plate 4 is provided, as shown in FIG. 8. A portion of the side plate 4 in an area behind the bracket attaching section 25*a* is thinner than the bracket attaching section 25*a* and has the same depth as the second fitting concave section 252.

As a result of this structure, when the second fitting sections 25 and the first fitting sections 101 of the side wall sections 10 of the instrument main body 2 are fitted together, the top plate 12 above the side wall sections 10 is arranged on the upper end surfaces of the bracket attaching sections 25*a* and the back plate 11 is arranged over the opening behind the bracket attaching sections 25*a*, with upper rear portions of the first fitting convex sections 102 of the side wall sections 10 being arranged under the bracket attaching sections 25*a* provided on the upper rear portions of the second fitting sections 25, as shown in FIG. 7, FIG. 8, FIG. 13 and FIG. 14. Consequently, the second fitting sections 25 hide the pair of side wall sections 10, and whereby the pair of side wall sections 10 are not seen from outside.

Figure 9:
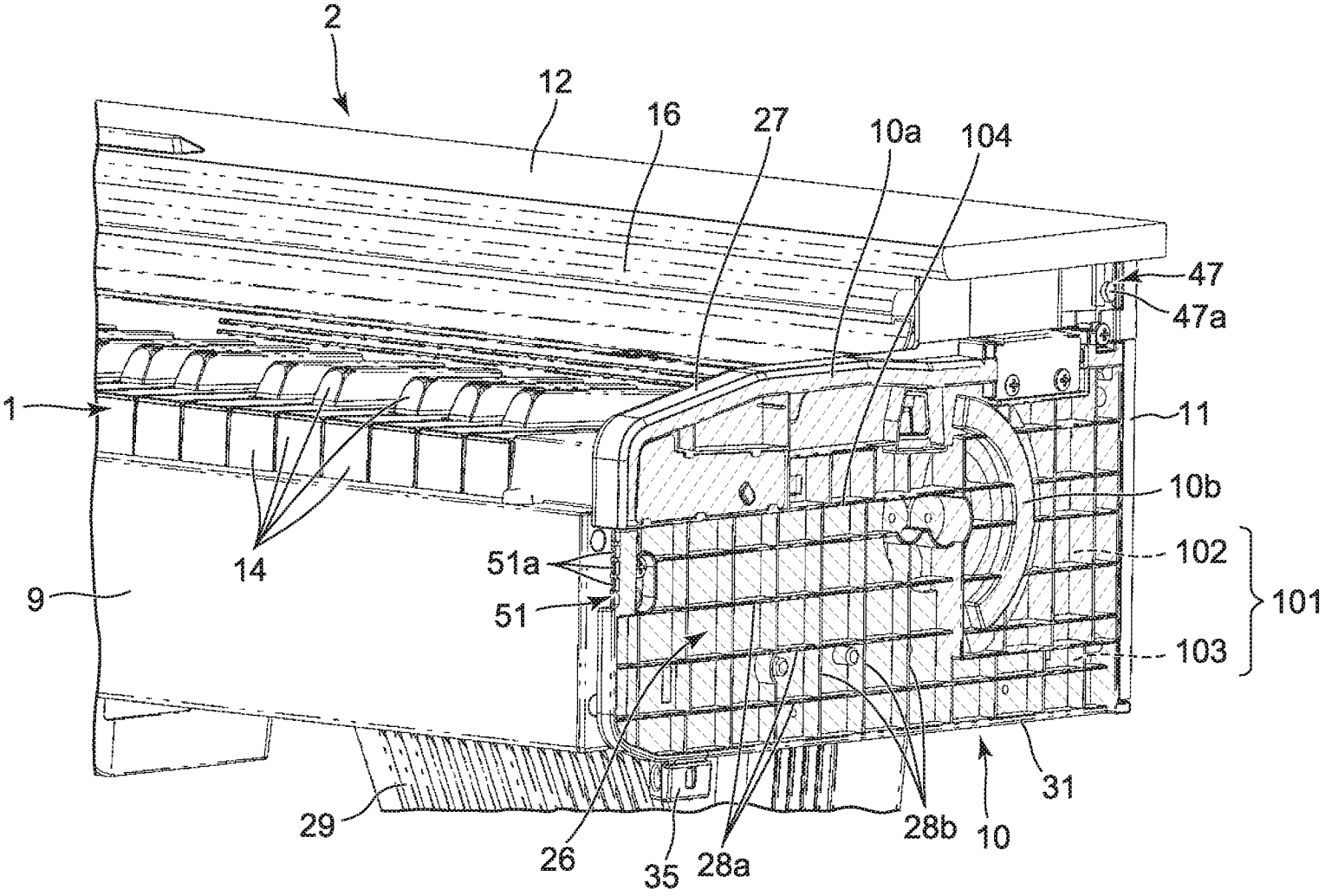
FIG. 9 is an enlarged perspective view of the main portion, in which a side wall section on the left side of the instrument main body of the keyboard instrument in FIG. 7 is shown.
Figure 10:
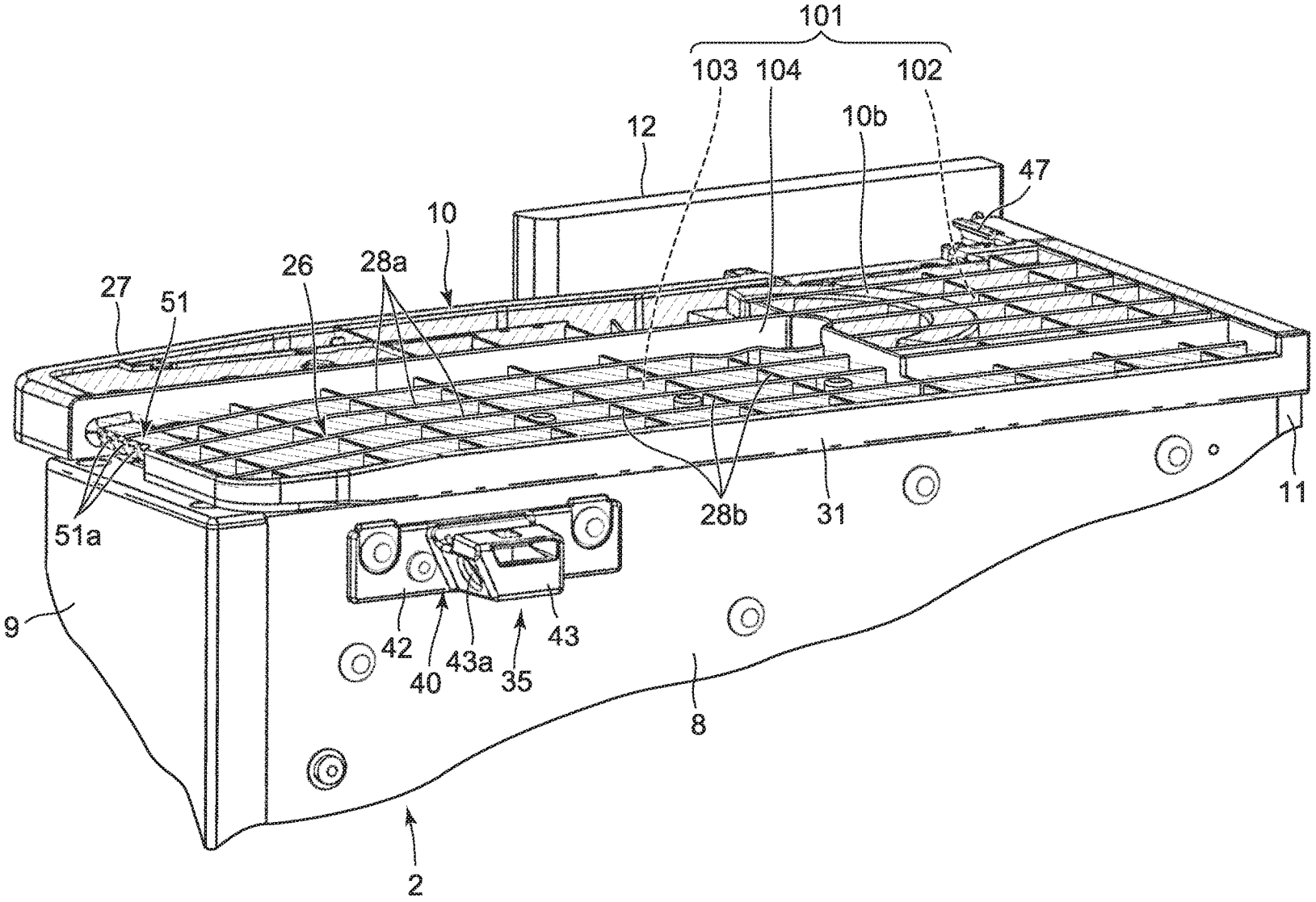
FIG. 10 is an enlarged perspective view of the left side wall section of FIG. 9 when viewed from the anteroinferior direction.

Also, the first fitting section 101 of each side wall section 10 of the instrument main body 2 is formed such that its outer periphery shape is substantially the same as the inner periphery shape of the second fitting section 25 of the corresponding side plate 4, as shown in FIG. 9 and FIG. 10. Also, the first fitting section 101 is formed such that the thickness of its first fitting convex section 102 is substantially the same as the depth of the second fitting concave section 252 of the second fitting section 25 in the thickness direction, across an area from the front end of the first fitting convex section 102 to the rear end, and the thickness of its first fitting concave section 103 is slightly smaller than the thickness of the second fitting convex section 251, across an area from the front end of the first fitting concave section 103 to the rear end.

Also, the first fitting concave section 103 is formed such that its front portion has a taper shape, as shown in FIG. 7, FIG. 9 and FIG. 10. That is, the first fitting section 101 is formed such that the vertical length of its front portion is shorter than the vertical length of the rear end of the second fitting section 25 of the side plate 4. On the outer surface of the first fitting concave section 103, a side surface guide section 26 having a sloped shape is provided.

This side surface guide section 26 is sloped such that the length (thickness) of the front part of the first fitting concave section 103 of the first fitting section 101 of the side wall section 10 in the thickness direction gradually becomes smaller (thinner) than the length (depth) of the second fitting convex section 251, from the rear end of this front part, that is, from a substantially middle portion of the first fitting concave section 103 in the front-rear direction toward the front end of the first fitting section 101 of the side wall section 10, as shown in FIG. 10.

On the upper end surface of the first fitting section 101 of the side wall section 10, that is, the upper end surface of the first fitting convex section 102, an upper side guide section 27 having a sloped shape is provided, as shown in FIG. 7, FIG. 9 and FIG. 10. This upper side guide section 27 is sloped such that the vertical length of the first fitting section 101 of the side wall section 10 which is fitted into the second fitting section 25 gradually becomes smaller from an area corresponding to the rear end of the front part of the first fitting section 101, that is, from an area closer to the front than a middle portion of the first fitting section 101 in the front-rear direction toward the front end of the first fitting section 101. As a result, each side wall section 10 is formed such that its front side has a taper shape.

Accordingly, when the first fitting sections 101 on the side wall sections 10 of the instrument main body 2 are to be inserted into the second fitting sections 25 in the side plates 4 of the stand 3, since the front side of each side wall section 10 has a taper shape, or in other words, since the vertical lengths of the rear ends of the second fitting sections 25 are larger than the vertical lengths of the front ends of the first fitting sections 101 on the side wall sections 10, the front sides of the first fitting sections 101 can be easily inserted into the rear sides of the second fitting sections 25, as shown in FIG. 7, FIG. 13 and FIG. 14.

That is, the instrument main body 2 has a structure where the thickness of the front end of each side wall section 10 is small because of the slope-shaped side surface guide section 26 provided on the outer front surface of the first fitting section 101 of each side wall section 10, and the vertical length of the front side of the first fitting section 101 on each side wall section 10 is smaller than the vertical length of the rear end of each second fitting section 25 because of the slope-shaped upper side guide section 27 provided on the upper front end of each side wall section 10, as shown in FIG. 7, FIG. 13 and FIG. 14.

Accordingly, when the instrument main body 2 is to be inserted between the pair of side plates 4 of the stand 3 with its rear side as a leading end, the front side of each first fitting section 101 on the pair of side wall sections 10 can be easily inserted into the rear side of each second fitting section 25 in the pair of side plates 4, as shown in FIG. 13 and FIG. 14. In this embodiment, each second fitting section 25 has a slope section 25*b* provided to the first upper end section 25*d* on the inner front side of the corresponding second fitting concave section 252 and having the same shape as that of the upper side guide section 27 on the upper end surface of each side wall section 10.

As a result, each second fitting section 25 has a structure in which, when the first fitting section 101 of the corresponding side wall section 10 is fitted thereinto, the upper end of the side wall section 10 comes in close contact with the first upper end section 25*d* of the second fitting section 25, the upper side guide section 27 of the side wall section 10 comes in close contact with the slope section 25*b* of the second fitting section 25, and the front end of the side wall section 10 comes in contact with or comes close to the inner surface of the front end 25*c* of the second fitting section 25, as shown in FIG. 14.

Also, each second fitting section 25 has a structure in which, when the first fitting section 101 of the corresponding side wall section 10 is fitted thereinto, the upper rear portion of the first fitting convex section 102 on the side wall section 10 is arranged under the second upper end section 25*e* that is the undersurface of the bracket attaching section 25*a* on the upper rear portion of the second fitting section 25 without coming in contact with the second upper end section 25*e*, and the back plate 11 is arranged over the opening of the rear end of the second fitting section 25 and thereby located across an area from the lower end of the opening to the upper end so as to cover the opening of the rear end, as shown in FIG. 14.

In this embodiment, the first fitting section 101 of each side wall section 10 includes the first guide section 104 which is provided between the first fitting convex section 102 and the first fitting concave section 103 and corresponds to one of the second guide sections 253, as shown in FIG. 9, FIG. 10 and FIG. 13. The front side of the first guide section 104 is positioned slightly higher than a substantially middle portion of the first fitting section 101 in the vertical direction, the rear side thereof is positioned lower than the front side, and a portion thereof corresponding to a substantially middle portion of the first fitting section 101 in the front-rear direction includes a stepped portion. As a result, the first guide section 104 has a step shape as a whole, which is the same shape as the second guide section 253.

On the outer surface of each side wall section 10, a plurality of lateral ribs 28*a* and a plurality of longitudinal ribs 28*b* are provided in a lattice shape, as shown in FIG. 9 and FIG. 10. The plurality of lateral ribs 28*a* is provided along the front-rear direction of the corresponding side wall section 10 and reinforces it. The plurality of longitudinal ribs 28*b* is provided along the vertical direction of the side wall section 10 and reinforces it. In this embodiment, lateral ribs 28*a* and longitudinal ribs 28*b* located on the front side of the first fitting concave section 103 of the side wall section 10 are provided to be sloped along the slope of the side surface guide section 26.

Also, the plurality of lateral ribs 28*a* is provided such that their outer edges on their outer side project further outside the side wall section 10 than the outer edges of the plurality of longitudinal ribs 28*b*, as shown in FIG. 9 and FIG. 10. Accordingly, when the first fitting section 101 is inserted into the second fitting section 25 of the corresponding side plate 4, the plurality of lateral ribs 28*a* comes in contact with and slides on the inner surface of the second fitting section 25 without the plurality of longitudinal ribs 28*b* coming in contact with the inner surface of the second fitting section 25, whereby the side wall section 10 is smoothly inserted into the second fitting section 25, as shown in FIG. 13.

On the stand 3, guide members 30 are provided which guide the first fitting sections 101 of the side wall sections 10 of the instrument main body 2 with respect to the second fitting sections 25 when the first fitting sections 101 of the pair of side wall sections 10 on the sides of the instrument main body 2 are slid and fitted into the second fitting sections 25 in the pair of side plates 4, as shown in FIG. 7 to FIG. 11.

Each guide member 30 includes a guide rail 33 which forms a guide groove 32 between it and the second fitting convex section 251 of the corresponding second fitting section 25 into which one of the pair of side wall sections 10 is fitted, as shown in FIG. 7 to FIG. 11. These guide rails 33 are attached to the pair of side plates 4 by screws 30*a* along the front-rear direction. As a result, each guide rail 33 guides a guide projection 31 provided on the lower part of the corresponding side wall section 10 along the front-rear direction, by the guide groove 32 formed between the guide rail 33 and the corresponding second fitting convex section 251.

Figure 11A:
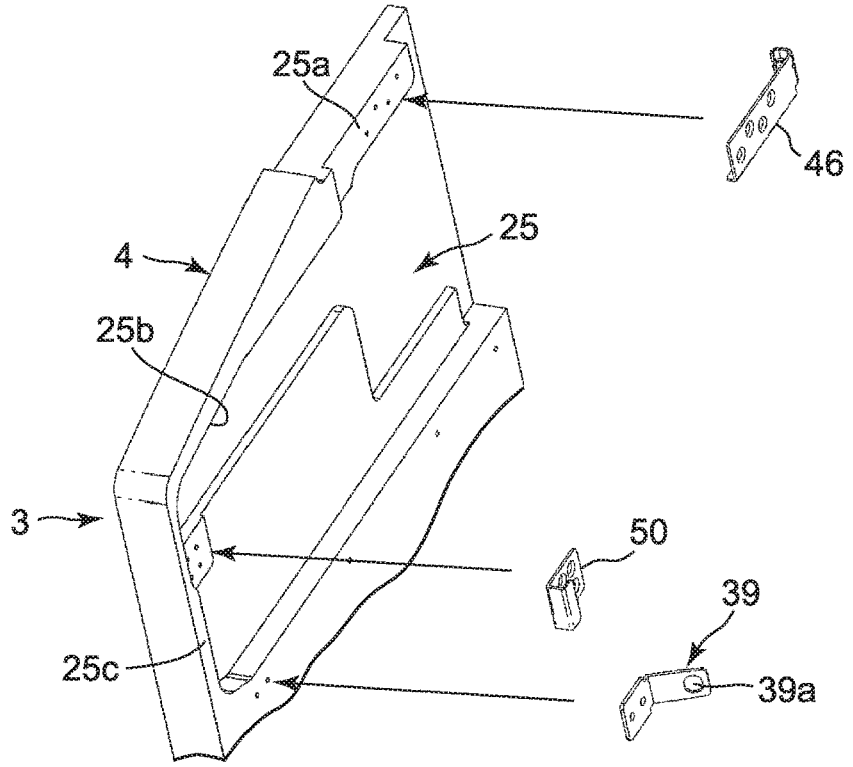
Figure 11B:
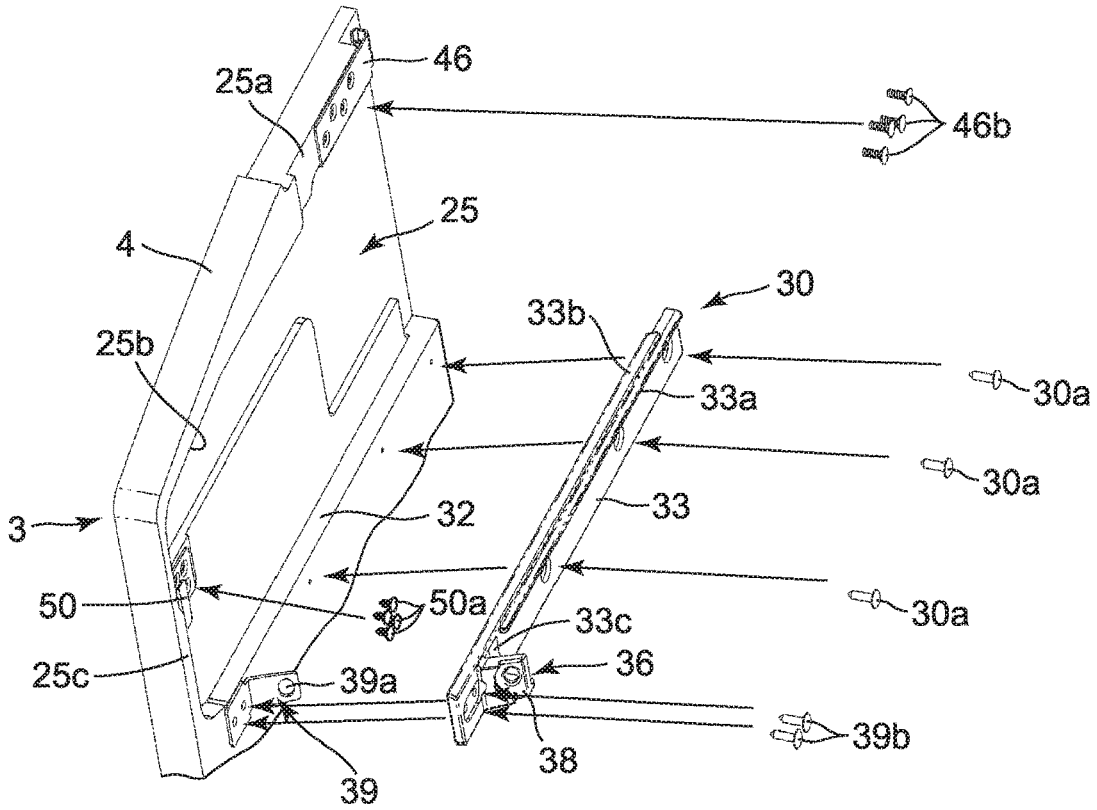

On the upper part of each guide rail 33, an auxiliary rib 33*a* is provided projecting toward the opposing surface of the opposing side plate 4, as shown in FIG. 8 and FIG. 11B. These auxiliary ribs 33*a* are to prevent the instrument main body 2 from being carelessly dropped when the instrument main body 2 is arranged between the pair of side plates 4, and thereby ensure the user's safety. Also, on the top end surfaces of the guide rails 33, rail projection pieces 33*b* for forming the guide grooves 32 are provided along the guide rails 33.

On the instrument main body 2 and the stand 3, front side fixing members 34 are provided which fix lower right and lower left front portions of the instrument main body 2 and front portions of the pair of side plates 4 corresponding thereto, on the front sides of the instrument main body 2 and the stand 3, as shown in FIG. 7 to FIG. 11. These front side fixing members 34 fix the instrument main body 2 to the pair of side plates 4 of the stand 3 and prevent it from being moved in the front-rear direction and the right-left direction perpendicular thereto.

More specifically, the front side fixing members 34 include main body fixing sections 35 provided on right and left front portions of the undersurface of the bottom plate 8 of the instrument main body 2, side plate fixing sections 36 provided on front side portions of the pair of side plates 4 corresponding to the main body fixing sections 35, and a plurality of front side screw members 37 (third fixing members) each of which fastens one of the side plate fixing sections 36 to one of the main body fixing section 35 by being diagonally screwed thereinto toward a rear sideward direction from in front of the instrument main body 2, as shown in FIG. 7 to FIG. 15A.

Each side plate fixing section 36 includes a rail fixing body 38 provided on the guide rail 33 of the corresponding guide member 30, a reinforcing plate 39 provided on the corresponding side plate 4, as shown in FIG. 8, FIG. 11, FIG. 13 and FIG. 15A. The rail fixing body 38 is provided on the front side of the guide rail 33 with it being tilted toward a rear sideward portion of the stand 3.

The reinforcing plate 39 is formed by a metal plate being bent such that its rear end is oriented toward the rear sideward portion of the stand 3, and is attached to the side plate 4, as shown in FIG. 8, FIG. 11, FIG. 13 and FIG. 15A. That is, the reinforcing plate 39 is provided such that its diagonally bent portion is arranged on the rear surface of the rail fixing body 38 via an opening 33*c* in the guide rail 33 with it being tilted toward a rear sideward portion of the pair of side wall sections 10.

Figure 15A:
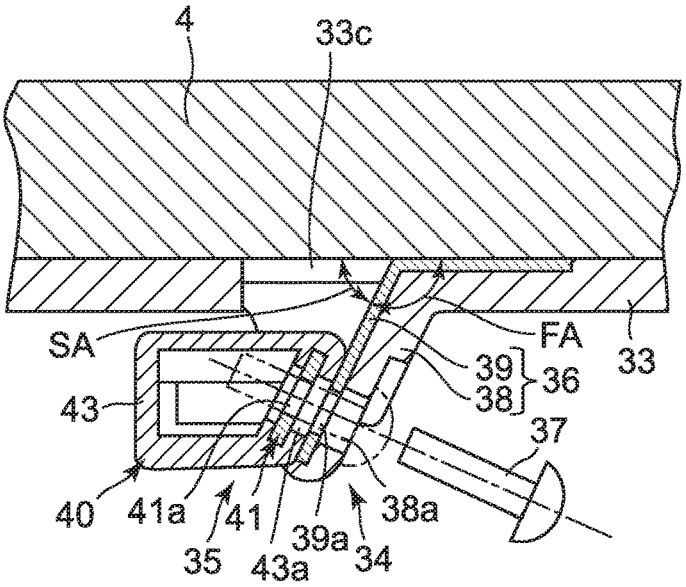
Figure 15B:
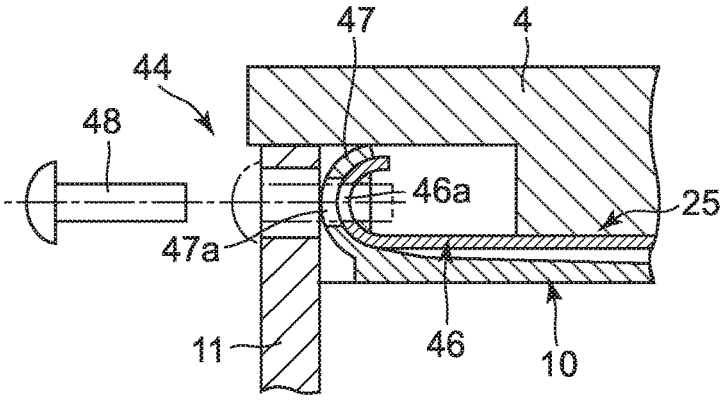
Figure 15C:
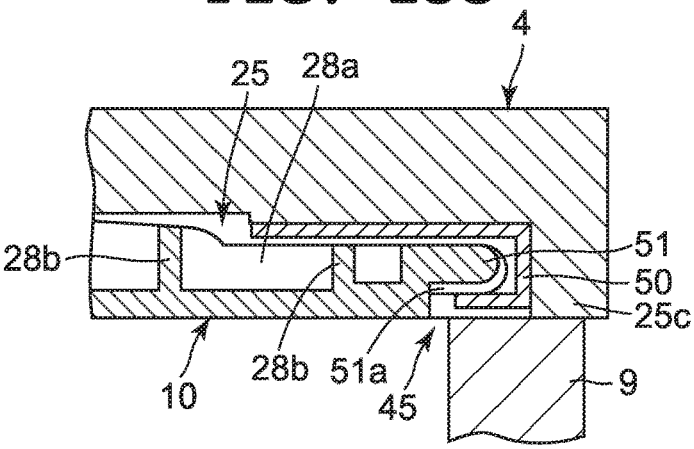

In this embodiment, in the rail fixing body 38, a first insertion hole 38*a* is provided into which one of the front side screw members 37 is diagonally inserted toward a rear sideward direction from in front of the instrument main body 2, as shown in FIG. 15A. Also, in the reinforcing plate 39, a second insertion hole 39*a* where the front side screw member 37 is inserted is provided in a manner to be positioned coaxially with the first insertion hole 38*a* of the rail fixing body 38.

Also, the main body fixing section 35 of each front side fixing member 34 includes an instrument fixing body 40 provided on the front undersurface of the bottom plate 8 of the instrument main body 2, and a metal screw fixing piece 41 arranged in the instrument fixing body 40 with it being tilted toward a rear sideward portion of the instrument main body 2, as shown in FIG. 10 and FIG. 12 to FIG. 15A. The instrument fixing body 40 includes an attaching section 42 which is attached to the undersurface of the bottom plate 8 of the instrument main body 2, and a cylinder section 43 integrally provided on the undersurface of the attaching section 42, as shown in FIG. 12A and FIG. 12B.

Figure 12A:
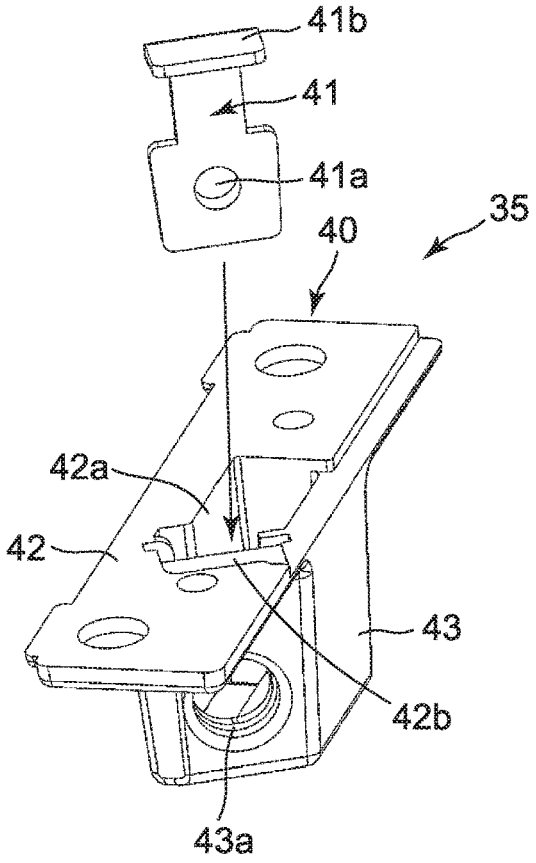
Figure 12B:
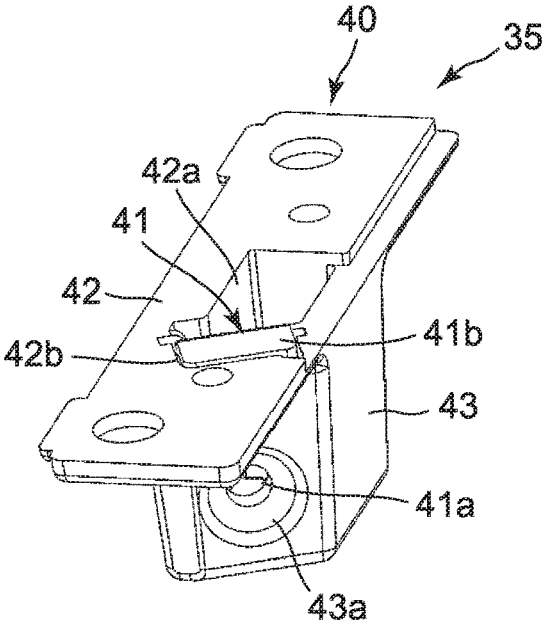

The cylinder section 43 of the instrument fixing body 40 is provided on the undersurface of the attaching section 42 such that its upper portion corresponds to an opening 42*a* in the attaching section 42, as shown in FIG. 12A and FIG. 12B. Also, the cylinder section 43 is provided on the attaching section 42 with its front portion being tilted toward the rear sideward portion of the instrument main body 2 as with the corresponding rail fixing body 38.

The screw fixing piece 41 is formed by a metal plate being bent such that its upper section 41*b* is oriented toward the front side of the instrument main body 2, as shown in FIG. 12A and FIG. 12B. When the screw fixing piece 41 is inserted into the cylinder section 43 from the opening 42*a* of the attaching section 42, the upper section 41*b* formed by the bending is arranged in an attachment recess section 42*b* of the attaching section 42 and, in this state, the screw fixing piece 41 is arranged on the inner surface of the cylinder section 43.

In this embodiment, in a front end portion of the cylinder section 43, a third insertion hole 43*a* is provided in which one of the front side screw member 37 is diagonally inserted towards a rear sideward direction from in front of the instrument main body 2, as shown in FIG. 12 and FIG. 15. Also, in the screw fixing piece 41, a screw hole 41*a* where the front side screw member 37 is screwed is provided corresponding to the third insertion hole 43*a* of the instrument fixing body 40 in a manner to be positioned coaxially with the third insertion hole 43*a*.

As a result, the front side fixing members 34 are structured such that, when the pair of side wall sections 10 on the right and left sides of the instrument main body 2 is inserted and fitted into the second fitting sections 25 in the pair of side plates 4 from behind the side plates 4, the instrument fixing bodies 40 of the main body fixing sections 35 provided on the instrument main body 2 come in contact with or come close to the reinforcing plates 39 of the side plate fixing sections 36 provided on the pair of side plates 4, as shown in FIG. 13 to FIG. 15A.

In this embodiment, the opposing surfaces of one main body fixing section 35 and the corresponding side plate fixing section 36 are tilted toward a rear sideward direction from the front side of the instrument main body 2, as shown in FIG. 15A. That is, an angle formed in front of the opposing surfaces with respect to the inner surface of the corresponding side plate (an angle formed at a position closer to the front of the instrument main body: first angle FA) is larger than an angle formed behind the opposing surfaces with respect to the inner surface of the corresponding side plate (an angle formed at a position closer to the rear of the instrument main body: second angle SA). Also, each front side screw member 37 is diagonally inserted through the first insertion hole 38*a* and the second insertion hole 39*a* of the corresponding side plate fixing section 36 and the third insertion hole 43*a* and the screw hole 41*a* of the corresponding main body fixing section 35 from in front of the instrument main body 2 toward a rear sideward direction.

Also, each front side fixing member 34 is structured such that, when its main body fixing section 35 comes in contact or comes close to its side plate fixing section 36, the first insertion hole 38*a* in the rail fixing body 38 of the side plate fixing section 36, the second insertion hole 39*a* in the reinforcing plate 39 of the side plate fixing section 36, the third insertion hole 43*a* in the cylinder section 43 of the instrument fixing body 40 of the main body fixing section 35, and the screw hole 41*a* in the screw fixing piece 41 of the main body fixing section 35 are arranged corresponding to and coaxially with one another with them being tilted toward a rear sideward direction from the front side, as shown in FIG. 14 and FIG. 15A.

As a result, each front side fixing member 34 is structured such that, when one of the front side screw members 37 is inserted into the first insertion hole 38*a* of the rail fixing body 38, the second insertion hole 39*a* of the reinforcing plate 39, and the third insertion hole 43*a* of the cylinder section 43 of the instrument fixing body 40 from ahead of the instrument main body 2 and the stand 3, and screwed into the screw hole 41*a* of the screw fixing piece 41 so as to be tightened, the instrument fixing body 40 is pulled toward the side plate fixing section 36, whereby the instrument main body 2 is fixed on the stand 3, as shown in FIG. 15A.

Here, in the front side fixing member 34, when the instrument fixing body 40 is to be pulled toward and pressed against the side plate fixing section 36, the front side screw member 37 diagonally fastens the instrument fixing body 40 and the side plate fixing sections 36 together by being screwed thereinto toward a rear sideward direction from the front side, whereby the instrument main body 2 can be fixed so as not to be moved in a front-rear direction with respect to the stand 3 and also not to be moved in a right-left direction with respect to the stand 3, as shown in FIG. 14 and FIG. 15A.

Also, on the instrument main body 2 and the stand 3, rear side fixing members 44 which fix, in areas corresponding to the rear of the instrument main body 2, rear end portions of the side wall sections 10 on the sides of the instrument main body 2 and rear end portions of the pair of side plates 4 corresponding thereto, and position restriction members 45 which restrict the positions of the side wall sections 10 of the instrument main body with respect to the second fitting sections 25 in the pair of side plates 4, as shown in FIG. 7 and FIG. 13 to FIG. 15.

The rear side fixing members 44 include locking sections 46 provided on upper rear portions of the pair of side plates 4, fitting sections 47 provided on upper rear portions of the side wall sections 10 on the sides of the instrument main body 2 so as to be fitted together with the locking sections 46, and rear side screw members 48 each of which fixes one of the fitting sections 47 and the corresponding locking section 46 fitted thereinto, as shown in FIG. 7 and FIG. 13 to FIG. 15B.

Each locking section 46, which is formed by a rear end portion of a metal plate being bent in a substantially U shape, has a screw hole 46*a* provided in the bent portion having the substantially U shape, and is attached to the bracket attaching section 25*a* on the upper rear portion of the second fitting section 25 in the corresponding side plate 4 by a screw 46*b* (refer to FIG. 11B), with the convex side of the substantially U shape being oriented in the rear direction of the side plate 4, as shown in FIG. 8, FIG. 11, and FIG. 13 to FIG. 15B.

Also, each fitting section 47 has a substantially U shape and is provided on an upper rear portion of the corresponding side wall section 10 of the instrument main body 2, as shown in FIG. 7 and FIG. 13 to FIG. 15B. This fitting section 47, which has a screw insertion hole 47*a* provided in the center of the substantially U shape, is arranged with the concave side of the substantially U shape being oriented in the front direction of the instrument main body 2, and the corresponding locking section 46 is fitted into the substantially U shape portion.

As a result, the rear side fixing members 44 are structured such that, when the pair of side wall sections 10 on the right and left sides of the instrument main body 2 is inserted and fitted into the second fitting sections 25 of the pair of side plates 4 from behind the pair of side plates 4, the locking sections 46 provided on the upper rear portions of the pair of side plates 4 are relatively fitted into the fitting sections 47 on the pair of side wall sections 10 of the instrument main body 2, as shown in FIG. 13 to FIG. 15B.

Moreover, the rear side fixing members 44 are structured such that, when the locking sections 46 of the pair of side plates 4 are fitted into the fitting sections 47 of the pair of side wall sections 10 of the instrument main body 2, the screw hole 46*a* provided in each locking section 46 and the screw insertion hole 47*a* provided in each fitting section 47 coaxially and substantially horizontally correspond to each other, as shown in FIG. 13 to FIG. 15B.

As a result, the rear side fixing members 44 are structured such that, when the rear side screw members 48 are inserted into the screw insertion holes 47*a* of the fitting sections 47 from behind the instrument main body 2 with the screw holes 46*a* of the locking sections 46 and the screw insertion holes 47*a* of the fitting sections 47 coaxially corresponding to each other, and the inserted rear side screw members 48 are screwed into the screw holes 46*a* of the locking sections 46 and fastened, the rear parts of the pair of side wall sections 10 are fixed to the rear parts of the pair of side plates 4, as shown in FIG. 13 to FIG. 15B.

On the other hand, each position restriction member 45 includes a hook section 50 attached to an inner front portion of the second fitting section 25 of the corresponding side plate 4 by screws 50*a*, and an engaging section 51 integrally provided on a front end portion of the corresponding side wall section 10 on a side of the instrument main body 2 so as to be engaged with the hook section 50, as shown in FIG. 7 to FIG. 11 and FIG. 13 to FIG. 15C.

The hook section 50 is formed by an end portion of a metal plate being bent in a substantially U shape, and is attached to the second fitting section 25 by the screws 50*a* (refer to FIG. 11B) such that the end portion bent in the substantially U shape comes in contact with or is positioned close to the front end 25*c* in the second fitting section 25, as shown in FIG. 8 and FIG. 13 to FIG. 15C.

The engaging section 51, which is a thin wall section provided on the front end portion of the side wall section 10, has a plurality of guide ribs 51*a* arranged on the surface of this thin wall section along the front-rear direction so as to form a comb teeth shape, and is inserted into and engaged with the hook section 50 by being guided by the plurality of guide ribs 51*a*, as shown in FIG. 10 and FIG. 13 to FIG. 15C.

As a result, the position restriction members 45 are structured such that, when the pair of side wall sections 10 on the right and left sides of the instrument main body 2 is inserted and fitted into the second fitting sections 25 of the pair of side plates 4 from behind the pair of side plates 4, the engaging sections 51 provided on the pair of side wall sections 10 of the instrument main body 2 are inserted into and engaged with the hook sections 50 attached to the pair of side plates 4, whereby the positions of the side wall sections 10 with respect to the second fitting sections 25 are restricted, as shown in FIG. 13 to FIG. 15C.

Next, the mechanism of this keyboard instrument is described.

In the assembly of the keyboard instrument, the instrument main body 2 and the stand 3 are individually assembled in advance. More specifically, in the assembly of the instrument main body 2, the front plate 9 is attached to the front end of the bottom plate 8, and then the pair of side wall sections 10 are attached to the sides of the bottom plate 8.

In this state, the keyboard unit 1 and the keyboard cover 16 are mounted in the instrument main body 2. Subsequently, the back plate 11 is attached to the rear end of the bottom plate 8 of the instrument main body 2, and the top plate 12 is attached to the upper parts of the back plate 11 and the pair of side wall sections 10. Then, the loudspeaker sections 29 are attached to the undersurface of the bottom plate 8 of the instrument main body 2. As a result, the instrument main body 2 is assembled.

On the other hand, in the assembly of the stand 3, the rear plate 5 is arranged between the rear end portions of the pair of side plates 4 opposing each other, and the pedal member 6 is arranged between the lower parts of the pair of side plates 4. Here, on the pedal member 6, the plurality of foot pedals 7 have been mounted in advance. As a result, the stand 3 is assembled.

Then, the instrument main body 2 is attached to the stand 3. In this attachment, first, the side plate fixing sections 36 of the front side fixing members 34, the guide rails 33 of the guide members 30, the locking sections 46 of the rear side fixing members 44, and the hook sections 50 of the position regulation members 45 are attached to the opposing surfaces of the pair of side plates 4. Here, the reinforcing plates 39 of the front side fixing members 34 are attached to front areas located on the opposing surfaces of the side plates 4 and positioned below the second fitting sections 25 of the side plates 4.

Then, the reinforcing plates 39 of the front side fixing members 34 are inserted into the openings 33*c* in the guide rails 33. In this state, the guide rails 33 are fixed on areas below the second fitting sections 25 on the opposing surfaces of the side plates 4 by the screws 30*a*. As a result, the guide grooves 32 are formed between the rail projection piece 33*b* of each guide rail 33 and the inner surface of each second fitting section 25.

In this embodiment, the reinforcing plates 39 are arranged on the rear surfaces of the rail fixing bodies 38 of the front side fixing members 34 on the guide rails 33. By these reinforcing plates 39, the rail fixing bodies 38 are reinforced. Here, the first insertion hole 38*a* of each rail fixing body 38 and the second insertion hole 39*a* of each reinforcing plate 39 coaxially correspond to each other with them being tilted toward a rear sideward direction from the front side.

Also, here, the locking sections 46 of the rear side fixing members 44 are attached to the bracket attaching sections 25*a* on the upper rear portions of the second fitting sections 25 in the pair of side plates 4 by the screws 46*b*, with the bent portion of each locking sections 46 in a substantially U shape being oriented toward the rear direction of the corresponding side plate 4. Similarly, the hook sections 50 of the position regulation members 45 are attached to the inner sides of the second fitting sections 25 by the screws 50*a*, with the bent portion of each hook section 50 in a substantially U shape being in contact with or being positioned close to the front end 25*c* of the second fitting section 25 in the corresponding side plate 4.

On the other hand, on right and left side front portions of the undersurface of the bottom plate 8 of the instrument main body 2, the main body fixing sections 35 of the front side fixing members 34 are attached. Here, the main body fixing sections 35 of the front side fixing members 34 are assembled in advance. That is, the screw fixing pieces 41 are inserted into the cylinder sections 43 of the instrument fixing bodies 40 of the main body fixing sections 35 from the openings 42*a* in the attaching sections 42 of the instrument fixing bodies 40. Accordingly, the upper sections 41*b* of the screw fixing pieces 41 are arranged in the attachment recess sections 42*b* of the attaching sections 42 and the screw fixing pieces 41 are arranged on rear inner surfaces of the cylinder sections 43.

As a result, the third insertion hole 43*a* in the cylinder section 43 of each instrument fixing body 40 and the screw hole 41*a* in each screw fixing piece 41 coaxially correspond to each other with them being tilted toward a rear sideward direction from the front side. Consequently, the main body fixing sections 35 are assembled. The attaching sections 42 of these main body fixing sections 35 are attached to the right and left side front portions of the undersurface of the bottom plate 8 of the instrument main body 2, whereby the main body fixing sections 35 are attached to the right and left side front portions of the undersurface of the bottom plate 8 of the instrument main body 2.

Here, the fitting sections 47 of the rear side fixing members 44 have been integrally provided on the upper rear portions of the pair of side wall sections 10 with the concave sides of their substantially U shape portions being oriented in the front direction. In addition, the engaging sections 51 of the position restriction members 45 have been integrally provided on the front end portions of the pair of side wall sections 10 with them being oriented in the front direction of the instrument main body 2.

The instrument main body 2 is attached to the stand 3 in this state. In this attachment, the first fitting sections 101 of the pair of side wall sections 10 on the right and left sides of the instrument main body 2 are fitted into the second fitting sections 25 provided in the opposing surfaces of the pair of side plates 4. Here, the first fitting sections 101 of the pair of side wall sections 10 of the instrument main body 2 are inserted into the second fitting sections 25 of the pair of side plates 4 from behind the stand 3, with the stand 3 standing upright by the pair of side plates 4 standing upright.

Here, the inner vertical length (entrance) of each second fitting section 25 on the rear side is larger (wider) than the inner vertical length thereof on the front side, and the vertical length of the rear end of each second fitting section 25 is larger than the vertical length of the front side of the first fitting section 101 of each side wall section 10. Accordingly, the front side of the first fitting section 101 of each side wall section 10 can be easily and favorably inserted into the rear side of each second fitting section 25 with a sufficient margin.

Also, the front side of each side wall section 10 has a taper shape and therefore can be easily inserted into the rear of each second fitting section 25. That is, the horizontal length of the front end of the first fitting concave section 103 of each side wall section 10 on the instrument main body 2 is smaller than the horizontal length of the rear end thereof, so that the front side of the first fitting section 101 of each side wall section 10 can be easily and favorably inserted into the rear side of each second fitting section 25 with a sufficient margin.

In this embodiment, the side surface guide sections 26 are provided on the outer front surfaces of the first fitting concave sections 103 on the side wall sections 10 of the instrument main body 2, by which the thickness of the front end of each side wall sections 10 is small. Accordingly, the length between the front ends of the pair of side wall sections 10 of the instrument main body 2 in the horizontal direction is larger than the length between the opposing surfaces of the second fitting sections 25 provided in the pair of side plates 4 of the stand 3.

As a result, in this keyboard instrument, by the front side of each side wall section 10 having a taper shape, the front side of the first fitting section 101 of each side wall section 10 can be easily and favorably inserted into the rear side of each second fitting section 25 with a sufficient margin when the first fitting sections 101 on the pair of side wall sections 10 of the instrument main body 2 are inserted into the second fitting sections 25 of the pair of side plates 4.

When the instrument main body 2 is to be inserted between the pair of side plates 4 from behind, since the auxiliary rib 33*a* of the guide rail 33 of each guide member 30 is projecting toward the inner surface of the opposing side plate 4, the lower parts of the side wall sections 10 of the instrument main body 2 can be arranged on the auxiliary ribs 33*a*, which prevents the instrument main body 2 from being carelessly dropped and thereby ensures the user's safety.

In this state, each guide projection 31 on the lower parts of the first fitting sections 101 on the pair of side wall sections 10 of the instrument main body 2 is arranged in the corresponding guide groove 32 formed between the rail projection piece 33*b* of each guide rail 33 attached to the pair of side plates 4 and the inner surface of the second fitting section 25 of each side plate 4. Here, since the front side of each side wall section 10 has a taper shape, the guide projections 31 of the pair of side wall sections 10 can be easily and favorably arranged in the guide grooves 32 formed in the second fitting sections 25 of the pair of side plates 4.

Accordingly, when the instrument main body 2 is moved toward the front side of the pair of side plate 4, the guide projection 31 of each side wall section 10 is slid along the corresponding guide groove 32 formed between the inner surface of the second fitting section 25 of each side plate 4 and the corresponding rail projection piece 33*b*. Here, the outer edges of the plurality of horizontal ribs 28*a* on the outer surface of each side wall section 10 project further outside the side wall section 10 than the outer edges of the plurality of longitudinal ribs 28*b*.

Therefore, when the first fitting sections 101 of the pair of side wall sections 10 are inserted into the second fitting sections 25 of the pair of side plates 4, the plurality of horizontal ribs 28*a* of each side wall section 10 is slid along the inner surface of the corresponding second fitting section 25 without the plurality of longitudinal ribs 28*b* coming in contact with the inner surface of the second fitting section 25. As a result, the inner surfaces of the second fitting sections 25 are not damaged by the plurality of longitudinal ribs 28*b*, and the pair of side wall sections 10 are smoothly slid and inserted into the second fitting sections 25 by the plurality of horizontal ribs 28*a*.

When the first fitting sections 101 on the pair of side wall sections 10 of the instrument main body 2 are fitted into the second fitting sections 25 of the pair of side plates 4 as described above, the first fitting convex sections 102 of the first fitting sections 101 are arranged in the second fitting concave sections 252 of the second fitting sections 25, and the first fitting concave sections 103 of the first fitting sections 101 are arranged in the second fitting convex sections 251 of the second fitting sections 25. Accordingly, the first guide sections 104 of the first fitting sections 101 are arranged corresponding to the second guide sections 253 of the second fitting sections 25.

In this state, the upper ends of the first fitting convex sections 102 of the first fitting sections 101 are in contact with the first upper end sections 25*d* of the second fitting concave sections 252 of the second fitting sections 25 and are not in contact with the second upper end sections 25*e* of the second fitting concave sections 252. Accordingly, the upper side guide sections 27 provided on the upper front portions of the side wall sections 10 are in close contact with the slope sections 25*b* of the first upper end sections 25*d* in the second fitting concave sections 252 of the second fitting sections 25, and the front ends of the side wall sections 10 are in contact with or are positioned close to the front ends 25*c* of the second fitting sections 25.

Also, here, the main body fixing sections 35 of the front side fixing members 34 provided on the instrument main body 2 correspond to the side plate fixing sections 36 of the front side fixing members 34 provided on the pair of side plates 4, and come in contact with or come close to them. In addition, the fitting sections 47 of the rear side fixing members 44 provided on the pair of side wall sections 10 of the instrument main body 2 correspond to the locking sections 46 of the rear side fixing members 44 provided on the pair of side plates 4, and are fitted together with the locking sections 46. Moreover, the engaging sections 51 of the position restriction members 45 provided on the pair of side wall sections 10 of the instrument main body 2 correspond to the hook sections 50 of the position restriction members 45 provided on the pair of side plates 4, and are fitted thereinto.

In this state, the opposing surfaces of the main body fixing section 35 and the side plate fixing section 36 of each front side fixing member 34 are corresponding to each other and are in contact with or positioned close to each other with them being tilted toward a rear sideward direction from the front side of the instrument main body 2. Also, here, the first insertion hole 38*a* provided in the rail fixing body 38 of the side plate fixing section 36 of each front side fixing member 34, the second insertion hole 39*a* provided in the reinforcing plate 39 of each side plate fixing section 36, the third insertion hole 43*a* provided in the cylinder section 43 of the instrument fixing body 40 of each main body fixing section 35, and the screw hole 41*a* provided in the screw fixing piece 41 of each main body fixing section 35 coaxially correspond to one another with them being tilted toward a rear sideward direction from the front side.

Accordingly, from in front of the instrument main body 2 and the stand 3, each front side screw member 37 is inserted into the first insertion hole 38*a* of the corresponding rail fixing body 38, the second insertion hole 39*a* of the corresponding reinforcing plate 39, and the third insertion hole 43*a* of the cylinder section 43 of the corresponding instrument fixing body 40, and screwed into the screw hole 41*a* of the corresponding screw fixing piece 41 so as to be tightened.

As a result, each instrument fixing body 40 is pulled toward the corresponding side plate fixing section 36, whereby the instrument main body 2 is fixed to the stand 3. Here, each front side screw member 37 tightens the main body fixing section 35 and the side plate fixing section 36 of the corresponding front side fixing member 34 with it being tilted toward a rear sideward direction from the front side of the instrument main body 2. Therefore, the instrument main body 2 is fixed in the front-rear direction with respect to the stand 3, and also fixed in the right-left direction with respect to the stand 3.

Also, in this state, the screw hole 46*a* provided in the locking section 46 of each rear side fixing member 44 and the screw insertion hole 47*a* provided in the fitting section 47 of each rear side fixing member 44 coaxially correspond to each other in a substantially horizontal state. Accordingly, the rear side screw member 48 of each rear side fixing member 44 is inserted into the screw insertion hole 47*a* of the corresponding fitting section 47 from behind the instrument main body 2, and screwed into the screw hole 46*a* of the corresponding locking section 46 so as to be tightened. As a result, rear portions of the pair of side wall sections 10 are fixed to rear portions of the pair of side plates 4 with the locking sections 46 being fitted into the fitting sections 47.

Moreover, in this state, the engaging sections 51 of the position regulation members 45 provided on the pair of side wall sections 10 of the instrument main body 2 have been fitted into the hook sections 50 of the position regulation members 45 provided on the pair of side plates 4. Here, the engaging sections 51 are thin walls provided on the front end portions of the side wall sections 10, and each of which has the plurality of guide ribs 51*a* arranged on its surface along the front-rear direction so as to form a comb teeth shape. Accordingly, each engaging section 51 is guided by the plurality of guide ribs 51*a*, and fitted into the corresponding hook section 50 so as to be locked.

As a result, when the pair of side wall sections 10 of instrument main body 2 is inserted and fitted into the second fitting sections 25 of the pair of side plates 4 from behind the pair of side plates 4, the engaging sections 51 of the pair of side wall sections 10 are fitted into the hook sections 50 of the pair of side plates 4, whereby the position regulation members 45 can accurately and favorably regulate the positions of the pair of side wall sections 10 with respect to the second fitting sections 25 of the pair of side plates 4.

Accordingly, by the regulation of the fitting positions of the first fitting sections 101 of the side wall sections 10 of the instrument main body 2 with respect to the second fitting sections 25 provided in the pair of side plates 4, damage to the front ends 25*c* of the second fitting sections 25 due to impact occurred by the front ends of the first fitting sections 101 of the pair of side wall sections 10 coming in contact with the front ends 25*c* of the second fitting sections 25 can be prevented, and the first fitting sections 101 of the side wall sections 10 can be accurately and favorably fitted into the second fitting sections 25.

When the pair of side wall sections 10 on the sides of the instrument main body 2 is attached between the pair of side plates 4 of the stand 3 as described above, both end portions of the top plate 12 in the right-left direction of the instrument main body 2 are arranged on the upper ends of the pair of side plates 4 and both end portions of the back plate 11 in the right-left direction of the instrument main body 2 are arranged in rear end areas of the second fitting sections 25 of the pair of side plates 4. As a result, the pair of side wall sections 10 of the instrument main body 2 is hidden from the outside, which simplifies the outer appearance and improves the design.

In the use of this keyboard instrument, first, the keyboard cover 16 is housed in the rear part of the instrument main body 2 so that the keyboard unit 1 is outwardly and upwardly exposed. Here, the front cover 17 and the rear cover 18 of the keyboard cover 16 are moved toward the rear part of the instrument main body 2. Then, while the front guide shafts 17*a* of the front cover 17 and the rear guide shafts 18*a* of the rear cover 18 are being moved along the first guide grooves 10*a* in the side wall sections 10, the rear cover 18 is gradually downwardly moved with respect to the front cover 17 by bending by the hinges 19.

Here, the support arms 20 are rotated clockwise around the support shafts 21 so as to pull the rear end of the rear cover 18 downward. Consequently, the rear cover 18 of the keyboard cover 16 bent by the hinges 19 hangs down in parallel with the back plate 11 at a position close to the back plate 11, and the front cover 17 is arranged under the top plate 12 with it being positioned substantially in parallel with the top plate 12, whereby the keyboard cover 16 is housed in the rear part of the instrument main body 2, as shown in FIG. 6. As a result, the keyboard unit 1 is exposed frontward and upward.

In this state, key depression operations for a musical performance can be performed on the plurality of keys 14 of the keyboard unit 1 exposed from the instrument main body 2. When key depression operations are performed on the plurality of keys 14 of the keyboard unit 1, hammer members 15 corresponding to the depressed keys 14 are rotated and apply action loads thereto. As a result of this structure, a key-touch feel close to that of an acoustic piano can be acquired, whereby a favorable musical performance can be performed. In addition, musical sounds in accordance with a musical performance can be favorably emitted from the loudspeaker sections 29.

Also, when the keyboard instrument is not in use, the front cover 17 and the rear cover 18 of the keyboard cover 16 are pulled toward the front direction of instrument main body 2 so as to cover the keyboard unit 1. In this case, the front guide shafts 17*a* of the front cover 17 and the rear guide shafts 18*a* of the rear cover 18 are moved along the first guide grooves 10*a* in the side wall sections 10 and, along with this movement, the support arms 20 are rotated counterclockwise around the support shafts 21 and thereby press the rear end of the rear cover 18 upward. As a result, the keyboard cover 16 is arranged above the keyboard unit 1 so as to cover the keyboard unit 1.

As described above, this keyboard instrument includes the instrument main body 2 having the keyboard unit 1, the stand 3 which supports the instrument main body 2, the main body fixing sections 35 which are first fixing members for fixing the instrument main body 2 to the stand 3, the side plate fixing sections 36 which are second fixing members for fixing the stand 3 to the instrument main body 2, and the front side screw members 37 each of which is a third fixing member for fixing one of the main body fixing sections 35 to one of the side plate fixing sections 36 with them being positioned in the front-rear direction of the instrument main body 2. Accordingly, the assembly thereof can be efficiently performed and the instrument main body 2 can be unfailingly and favorably mounted on the stand 3.

That is, in this keyboard instrument, in a state where the stand 3 is supporting the instrument main body 2, each of the main body fixing sections 35 and each of the side plate fixing sections 36 can be fixed to each other by one of the front side screw members 37 being screwed thereinto from in front of the instrument main body 2. Therefore, the assembling person does not need to crawl under the instrument main body 2 when fixing the instrument main body 2 to the stand 3. Accordingly, the assembly thereof can be efficiently performed and the instrument main body 2 can be unfailingly and favorably mounted on the stand 3.

In this embodiment, each main body fixing section 35 serving as a first fixing member includes the instrument fixing body 40 having the third insertion hole 43*a* and the screw fixing piece 41 having the screw hole 41*a*, and each side plate fixing section 36 serving as a second fixing member includes the rail fixing body 38 having the first insertion hole 38*a* and the reinforcing plate 39 having the second insertion hole 39*a*. Each front side screw member 37 serving as a third fixing member is screwed into the corresponding screw hole 41*a* through the corresponding first insertion hole 38*a*, second insertion hole 39*a*, and third insertion hole 43*a* arranged along the front-rear direction of the instrument main body 2, and thereby unfailingly fixes the main body fixing section 35 and the side plate fixing section 36 from in front of the instrument main body 2

That is, each front side fixing member 34 is structured such that, when the pair of side wall sections 10 on the instrument main body 2 is arranged between the pair of side plates 4 of the stand 3, the front surfaces of the main body fixing sections 35 provided on the front side of the undersurface of the instrument main body 2 correspond to the rear surfaces of the side plate fixing sections 36 provided on the front areas on the opposing surfaces of the side plates 4. In this state, each front side screw member 37 can be inserted into the corresponding first insertion holes 38*a*, second insertion hole 39*a*, and third insertion hole 43*a* from in front of the instrument main body 2, and screwed into the corresponding screw hole 41*a* so as to be tightened. As a result, each main body fixing section 35 and each side plate fixing section 36 can be unfailingly fixed to each other.

Also, each front side fixing member 34 is structured such that the abutting or adjacent opposing surfaces of the main body fixing section 35 and the side plate fixing section 36 are diagonally provided toward a rear sideward direction from the front side of the instrument main body 2, and one of the front side screw members 37 is diagonally inserted into the first insertion hole 38*a*, the second insertion hole 39*a*, and the third insertion hole 43*a* toward a rear sideward direction from in front of the instrument main body 2 and screwed into the screw hole 41*a*, whereby the main body fixing section 35 and the side plate fixing section 36 are unfailingly fixed to each other in the front-rear direction and the right-left direction.

That is, in this keyboard instrument, the front side fixing members 34 fix the instrument main body 2 with respect to the pair of side plates 4 of the stand 3 in two directions, that is, the front-rear direction and the right-left direction perpendicular thereto. Accordingly, the assembly thereof can be efficiently performed and the instrument main body 2 can be unfailingly and favorably mounted on the stand 3.

In this embodiment, the main body fixing sections 35 of the front side fixing members 34 are provided on the front side of the undersurface of the instrument main body 2, and the side plate fixing sections 36 of the front side fixing members 34 are provided on front side areas of the stand 3 which correspond to areas in front of the main body fixing sections 35. As a result, by fixing the side plate fixing sections 36 to the main body fixing sections 35 from in front of the instrument main body 2, the front side screw members 37 for the front side fixing members 34 can fix the main body fixing sections 35 and the side plate fixing sections 36 with the instrument main body 2 being supported by the stand 3, so that the assembling person does not need to crawl under the instrument main body 2 when fixing the instrument main body 2 to the stand 3.

Also, this keyboard instrument includes the guide members 30 which are provided on the surfaces of the pair of side plates 4 opposing the instrument main body 2 and guide the side wall sections 10 of the instrument main body 2. As a result, by the guide members 30, the side wall sections 10 of the instrument main body 2 can be favorably guided when the instrument main body 2 is arranged between the pair of side plates 4. Accordingly, the assembly thereof can be efficiently performed and the instrument main body 2 can be unfailingly and favorably mounted on the stand 3.

That is, the guide members 30 include the guide rails 33 which guide the lower ends of the side wall sections 10, and therefore can smoothly and favorably guide the side wall sections 10 of the instrument main body 2 by these guide rails 33 when the instrument main body 2 is arranged between the side plates 4. As a result, the side wall sections 10 can be unfailingly and favorably fitted into the second fitting sections 25.

In this embodiment, each guide rail 33 is attached to the corresponding side plate 4 along the front-rear direction and forms, between it and the second fitting section 25, the guide groove 32 for guiding the guide projection 31 of the corresponding side wall section 10. Accordingly, by the guide grooves 32, the guide projections 31 of the side wall sections 10 can be smoothly and favorably guided when the instrument main body 2 is arranged between the side plates 4. As a result, the side wall sections 10 can be unfailingly and favorably fitted into the fitting concave sections 25 of the side plates 4.

Also, in this keyboard instrument, the fitting concave sections 25 into which the pair of side wall sections 10 of the instrument main body 2 are fitted are provided in the pair of side plates 4 from their rear ends toward their front sides. As a result, the pair of side wall sections 10 of the instrument main body 2 can be slid and fitted into the fitting concave sections 25 of the pair of side plate 4 from behind the pair of side plates 4. Accordingly, the assembly thereof can be efficiently performed. In addition, the pair of side wall sections 10 of the instrument main body 2 can be hidden from the outside, which improves the design.

That is, each second fitting sections 25 is structured such that its front end 25*c* corresponding to the front side of the instrument main body 2 is walled and its rear end corresponding to the rear side of the instrument main body 2 is open, and the corresponding side wall section 10 is arranged therein with its front end being in contact with or being positioned close to the front end 25*c*0 of the second fitting section 25. As a result, when fitted into the second fitting sections 25, the side wall sections 10 are hidden, which improves the design.

In this embodiment, both ends of the top plate 12 of the instrument main body 2 are arranged on the upper ends of the pair of side plates 4, and both ends of the back plate 11 are arranged in the rear end areas of the second fitting sections 25 of the pair of side plates 4. As a result, the upper parts and the rear ends of the pair of side wall sections 10 on the instrument main body 2 can be reliably hidden from the outside, which simplifies the outer appearance of the entire keyboard instrument and further improves the design.

Also, this keyboard instrument includes the instrument main body 2 having the keyboard unit 1, the stand 3 which supports the instrument main body 2, the fitting sections 47 which are first fixing members for fixing the instrument main body 2 to the stand 3, the locking sections 46 which are second fixing members for fixing the stand 3 to the instrument main body 2, and the rear side screw members 48 each of which is a fixing member for fixing one of the fitting sections 47 to one of the locking sections 46 with them being positioned in the front-rear direction of the instrument main body 2. Accordingly, the assembly thereof can be efficiently performed and the instrument main body 2 can be unfailingly and favorably mounted on the stand 3.

That is, in this keyboard instrument, in a state where the stand 3 is supporting the instrument main body 2, each of the fitting sections 47 and each of the locking sections 46 can be fixed to each other by one of the rear side screw members 48 being screwed thereinto from behind the instrument main body 2, as in the case of the front side screw members 34. Therefore, the assembling person does not need to crawl under the instrument main body 2 when fixing the instrument main body 2 to the stand 3. Accordingly, the assembly thereof can be efficiently performed and the instrument main body 2 can be unfailingly and favorably mounted on the stand 3.

In this embodiment, each fitting section 47 serving as a first fixing member includes the screw insertion hole 47*a* and each locking section 46 serving as a second fixing member includes the screw hole 46*a*. Each rear side screw member 48 serving as a fixing member is screwed into the screw hole 46*a* of one of the locking sections 46 through the screw insertion hole 47*a* of the corresponding fitting section 47 with the screw hole 46*a* and the screw insertion hole 47*a* being arranged along the front-rear direction of the instrument main body 2, and unfailingly fixes the fitting section 47 to the locking section 46 from behind the instrument main body 2.

Also, in this keyboard instrument, the fitting sections 47 of the rear side fixing members 44 are provided on the rear end portions of the instrument main body 2, the locking sections 46 of the rear side fixing members 44 are provided on the rear end portions of the side plates 4 of the stand 3 which correspond to the fitting sections 47, and the rear side screw members 48 each fix one of the fitting sections 47 and one of the locking sections 46 to each other from behind the instrument main body 2. As a result of this structure, in a state where the stand 3 is supporting the instrument main body 2, the fitting sections 47 can be fixed to the locking sections 46 by the rear side screw members 48 being inserted from behind the instrument main body 2. Therefore, the assembling person does not need to crawl under the instrument main body 2 when fixing the instrument main body 2 to the stand 3.

In this embodiment, the locking sections 46 of the rear side fixing members 44 are attached to the upper rear portions of the fitting concave sections 25 of the pair of side plates 4 with each of their rear ends being bent in a substantially U shape and the convex side thereof being oriented in the rear direction of the corresponding side plate 4, and the fitting sections 47 of the rear side fixing members 44 are provided on the upper rear portions of the pair of side wall sections 10 with the concave side of each of their substantially U-shaped portions being oriented in the front direction of the instrument main body 2. As a result of this structure, by each locking section 46 being fitted into the corresponding fitting section 47, the rear end of each side wall section 10 and the rear end of each side plate 4 can be fixed to each other.

That is, each rear side fixing member 44 is structured such that one of the rear side screw members 48 is insert into the screw insertion hole 47*a* of its fitting section 47 from behind the instrument main body 2 with the screw hole 46*a* of its locking section 46 and the screw insertion hole 47*a* of the fitting section 47 coaxially corresponding to each other, and screwed into the screw hole 46*a* of the locking section 46 so as to be tightened. As a result of this structure, by each locking section 46 being fitted into the corresponding fitting section 47, the rear part of each side wall section 10 and the rear part of each side plate 4 can be firmly fixed to each other.

Also, this keyboard instrument includes the position regulation members 45 which regulate the positions of the side wall sections 10 of the instrument main body 2 with respect to the fitting concave sections 25 provided in the pair of side plates 4. Therefore, when the side wall sections 10 of the instrument main body 2 are fitted into the fitting concave sections 25 provided in the pair of side plates 4, the positions of the pair of side wall sections 10 of the instrument main body 2 can be accurately and favorably regulated in the fitting concave sections 25 provided in the pair of side plates 4.

That is, each position restriction member 45 includes the hook section 50 provided on the inner front portion of the corresponding second fitting section 25, and the engaging section 51 provided on the front end portion of the corresponding side wall section 10 of the instrument main body 2 so as to be engaged with the corresponding hook section 50. As a result, when the side wall sections 10 of the instrument main body 2 are arranged in the fitting concave sections 25 provided in the pair of side plates 4, the engaging sections 51 are engaged with the hook sections 50, whereby the positions of the pair of side wall sections 10 of the instrument main body 2 can be accurately and unfailingly regulated in the fitting concave sections 25 provided in the pair of side plates 4.

In the above-described embodiment, the side surface guide sections 26 and the upper side guide sections 27 on the front sides of the first fitting sections 101 on the pair of side wall sections 10 of the instrument main body 2 are formed on the linear slope portions. However, the present invention is not limited thereto. For example, they may be stepped slope portions sloped by sequential steps or be gently curved portions.

Also, in the above-described embodiment, the second fitting sections 25 are provided in both opposing surfaces of the pair of side plates of the stand 3. However, the present invention is not limited thereto. For example, a structure may be adopted in which only one of the opposing surfaces of the pair of side plates 4 is provided with a second fitting section 25.

Moreover, the present invention is not limited to the above-described embodiment where the second fitting sections 25 are provided in the opposing surfaces of the pair of side plates 4 of the stand 3, and the pair of side plates 4 is not necessarily required to have the second fitting sections 25. That is, a structure may be adopted in which the guide rails 33 are provided on the opposing surfaces of the pair of side plates 4 and the second fitting sections 25 are not provided in the opposing surfaces. In this structure, the instrument main body 2 is not necessarily required to be inserted from behind the stand 3, and may be inserted from in front of the stand 3 or from above the stand 3.

Furthermore, in the above-described embodiment, when the main body fixing section 35 and the side plate fixing section 36 of each front side fixing member 34 are to be fixed to each other by one of the front side screw members 37, the front side screw member 37 is screwed thereinto from in front of the instrument main body 2 with it being tilted toward a rear sideward direction. However, the present invention is not limited thereto. For example, a structure may be adopted in which the front side screw member 37 tilted toward the rear sideward direction is further tilted toward a rear upward direction, and fixes the main body fixing section 35 and the side plate fixing section 36 with it being tilted in this three-dimensional direction.

When each main body fixing section 35 and each side plate fixing section 36 are fixed to each other with the corresponding front side screw member 37 being tilted in the three-dimensional direction as described above, the instrument main body 2 can be fixed in three directions including the front-rear direction, the right-left direction, and the top-bottom direction with respect to the stand 3. As a result, the instrument main body 2 can be attached to the stand 3 more firmly and efficiently than the above-described embodiment.

Also, in the above-described embodiment, the main body fixing sections 35 are provided on the front side of the undersurface of the instrument main body 2 and the side plate fixing sections 36 are provided on the front side portions of the opposing surfaces of the side plates 4. However, the present invention is not limited thereto. For example, a structure may be adopted in which the main body fixing sections 35 are provided on the rear side of the undersurface of the instrument main body 2, the side plate fixing sections 36 are provided on the rear side portions of the opposing surfaces of the side plates 4, and the main body fixing sections 35 and the side plate fixing sections 36 are fixed by the front side screw members 37 being inserted thereinto from behind the instrument main body 2.

Moreover, in the above-described embodiment, the instrument main body 2 is fixed to the stand 3 by the front side fixing members 34 and the rear side fixing members 44. However, the present invention is not limited thereto. For example, a structure may be adopted in which the instrument main body 2 is fixed to the stand 3 only by the front side fixing member 34 or only by the rear side fixing member 44.

Furthermore, in the above-described embodiment, when the instrument main body 2 is to be attached to the stand 3, the instrument main body 2 is moved toward the stand 3. However, the present invention is not limited thereto. For example, the stand 3 may be moved toward the instrument main body 2, or both the instrument main body 2 and the stand 3 may be moved.

While the present invention has been described with reference to the preferred embodiments, it is intended that the invention be not limited by any of the details of the description therein but includes all the embodiments which fall within the scope of the appended claims.

What is claimed is:

1. A keyboard instrument comprising:

an instrument main body which has a first fixing member;

a stand which supports the instrument main body;

a guide rail which includes a second fixing member and guides the instrument main body so that the instrument main body is fitted into the stand; and a third fixing member which fixes the first fixing member and the second fixing member, wherein the first fixing member and the second fixing member are positioned in a front-rear direction of the instrument main body, and wherein the keyboard instrument does not include any fixing member, for fixing the instrument main body and the stand, that fixes the instrument main body and the stand in a direction from a lower side toward an upper side of the instrument main body.

2. The keyboard instrument according to claim 1, wherein the first fixing member has a first hole, the second fixing member has a second hole, and the third fixing member is inserted through the first hole and the second hole which are positioned in the front-rear direction of the instrument main body.

3. The keyboard instrument according to claim 2, wherein the first fixing member and the second fixing member are in contact with each other or are positioned close to each other, wherein a first angle formed in front of opposing surfaces of the first fixing member and the second fixing member with respect to an inner surface of the stand is larger than a second angle formed behind the opposing surfaces with respect to the inner surface of the stand, and wherein the third fixing member is diagonally inserted through the first hole and the second hole from in front of the instrument main body toward a rear sideward direction.

4. The keyboard instrument according to claim 1, wherein the first fixing member is provided on a front side of an undersurface of the instrument main body, wherein the second fixing member is provided on a front side area of the stand which corresponds to an area in front of the first fixing member, and wherein the third fixing member fixes the first fixing member and the second fixing member from in front of the instrument main body.

5. The keyboard instrument according to claim 1, further comprising:

a position regulation member which regulates a position of the instrument main body with respect to the stand.

6. The keyboard instrument according to claim 5, wherein the position regulation member includes a hook section which is provided on a front end portion of the stand and an engaging section which is provided on a front end portion of the instrument main body and engages with the hook section.

7. A keyboard instrument comprising:

an instrument main body which has a keyboard;

a stand which supports the instrument main body;

a first fixing member which has a first hole and fixes the stand to the instrument main body;

a second fixing member which has a second hole and fixes the instrument main body to the stand; and a third fixing member which fixes the first fixing member to the second fixing member by being inserted through the first hole and the second hole which are positioned in a front-rear direction of the instrument main body, wherein the first fixing member and the second fixing member are in contact with each other or are positioned close to each other, wherein a first angle formed in front of opposing surfaces of the first fixing member and the second fixing member with respect to an inner surface of the stand is larger than a second angle formed behind the opposing surfaces with respect to the inner surface of the stand, and wherein the third fixing member is diagonally inserted through the first hole and the second hole from in front of the instrument main body toward a rear sideward direction.

8. The keyboard instrument according to claim 7, wherein the first fixing member is provided on a front side of an undersurface of the instrument main body, wherein the second fixing member is provided on a front side area of the stand which corresponds to an area in front of the first fixing member, and wherein the third fixing member fixes the first fixing member and the second fixing member from in front of the instrument main body.

9. The keyboard instrument according to claim 7, further comprising:

a position regulation member which regulates a position of the instrument main body with respect to the stand.

10. The keyboard instrument according to claim 9, wherein the position regulation member includes a hook section which is provided on a front end portion of the stand and an engaging section which is provided on a front end portion of the instrument main body and engages with the hook section.

11. A keyboard instrument comprising:

an instrument main body which has a first fixing member including a first hole;

a stand which has a second fixing member including a second hole, and supports the instrument main body; and a third fixing member which fixes the first fixing member and the second fixing member by being inserted through the first hole and the second hole which are positioned in a front-rear direction of the instrument main body.

* * * * *